US011124375B2

(12) United States Patent
Matsuoka et al.

(10) Patent No.: US 11,124,375 B2
(45) Date of Patent: Sep. 21, 2021

(54) PAPER FEEDING DEVICE, IMAGE FORMING DEVICE, AND ELECTRODE FEEDING DEVICE

(71) Applicant: Kabushiki Kaisha Toshiba, Minato-ku (JP)

(72) Inventors: Kei Matsuoka, Kawasaki (JP); Kohei Nara, Yokohama (JP); Takahiro Kokubo, Kamakura (JP); Takamitsu Sunaoshi, Yokohama (JP); Shunsuke Hattori, Kawasaki (JP)

(73) Assignee: Kabushiki Kaisha Toshiba, Minato-ku (JP)

( * ) Notice: Subject to any disclaimer, the term of this patent is extended or adjusted under 35 U.S.C. 154(b) by 126 days.

(21) Appl. No.: 16/554,689

(22) Filed: Aug. 29, 2019

(65) Prior Publication Data

US 2020/0299080 A1 Sep. 24, 2020

(30) Foreign Application Priority Data

Mar. 18, 2019 (JP) ..... JP2019-049589

(51) Int. Cl.
*B65H 1/26* (2006.01)
*B65H 3/48* (2006.01)
*B65H 3/08* (2006.01)

(52) U.S. Cl.
CPC ..... *B65H 1/266* (2013.01); *B65H 3/08* (2013.01); *B65H 3/48* (2013.01)

(58) Field of Classification Search
CPC ..... B65H 1/266; B65H 3/08; B65H 3/0816; B65H 3/0833; B65H 3/0866; B65H 3/48;
(Continued)

(56) References Cited

U.S. PATENT DOCUMENTS 4,131,274 A * 12/1978 Sue ..... B65H 1/04 271/127
4,429,865 A * 2/1984 Okada ..... B65H 1/14 271/127

(Continued)

FOREIGN PATENT DOCUMENTS

JP 01-038096 Y2 11/1989
JP 2005-112560 A 4/2005

(Continued)

*Primary Examiner* — Gregory W Adams

(74) *Attorney, Agent, or Firm* — Oblon, McClelland, Maier & Neustadt, L.L.P.

(57) ABSTRACT

A paper feeding device has a paper feed tray, a device body, a fan, a rectifying member, and a retreat mechanism. A paper bundle in which a plurality of sheets of paper are stacked can be placed on the paper feed tray. The rectifying member is positioned above the paper bundle placed on the paper feed tray in a state in which the paper feed tray is accommodated in an accommodating part of the device body. The rectifying member generates a negative pressure between the rectifying member and an uppermost sheet of paper of the paper bundle using airflow from the fan in a state in which the paper feed tray is accommodated in the accommodating part. The retreat mechanism displaces the rectifying member in conjunction with the paper feed tray so that the rectifying member retreats from the paper feed tray in at least one of a pull-out operation and a push-in operation of the paper feed tray.

22 Claims, 24 Drawing Sheets

(58) Field of Classification Search
CPC ..... B65H 3/124; B65H 3/128; B65H 3/12; B65H 3/54; B65H 3/56
See application file for complete search history.

(56) References Cited

U.S. PATENT DOCUMENTS

| | | | | |
|---|---|---|---|---|
| 4,595,191 | A * | 6/1986 | Uchiyama | B65H 1/04 271/170 |
| 8,146,911 | B2 * | 4/2012 | Kozaki | B65H 3/5238 271/4.01 |
| 8,371,574 | B2 * | 2/2013 | Ichikawa | B65H 1/04 271/160 |
| 8,398,071 | B2 * | 3/2013 | Suzuki | B65H 3/48 271/98 |
| 8,991,814 | B2 * | 3/2015 | Hirahara | B65H 1/266 271/117 |
| 9,481,532 | B2 * | 11/2016 | Kuwata | B65H 1/04 |
| 9,725,265 | B2 * | 8/2017 | Hashimoto | B65H 1/14 |
| 2005/0063023 | A1 | 3/2005 | Komatsu et al. | |
| 2007/0045933 | A1 | 3/2007 | Okazaki | |
| 2019/0106284 | A1 | 4/2019 | Matsuoka et al. | |

FOREIGN PATENT DOCUMENTS

| | | | |
|---|---|---|---|
| JP | 2006-321629 | A | 11/2006 |
| JP | 2007-055786 | A | 3/2007 |
| JP | 4154299 | B2 | 9/2008 |
| JP | 2010-058917 | A | 3/2010 |

* cited by examiner

PAPER FEEDING DEVICE, IMAGE FORMING DEVICE, AND ELECTRODE FEEDING DEVICE

CROSS-REFERENCE TO RELATED APPLICATION

This application claims priority from Japanese Patent Application No. 2019-049589 filed on Mar. 18, 2019, the contents of which are incorporated herein by reference in their entirety.

FIELD

Embodiments described herein relate generally to a paper feeding device, an image forming device, and an electrode feeding device.

BACKGROUND

A paper feeding device includes a paper feed tray. A paper bundle in which a plurality of sheets of paper are stacked can be placed on the paper feed tray. For example, a pickup roller may be in contact with an upper surface of a paper bundle placed on a paper feed tray. When the pickup roller rotates, paper is fed out of the paper feed tray.

Incidentally, in paper feeding devices, it is required to feed one sheet of paper at a time from a paper bundle placed on a paper feed tray. In order to prevent paper from being sent out in a state in which a plurality of sheets overlap (multiple feeding), it is necessary to separate an uppermost sheet of paper (hereinafter referred to as "uppermost sheet of paper") on the paper bundle from the paper bundle placed on the paper feed tray.

In order to separate an uppermost sheet of paper from the paper bundle, a paper feeding device includes a rectifying member positioned above the paper bundle placed on the paper feed tray. The rectifying member generates a negative pressure between the rectifying member and an uppermost sheet of paper using airflow from a fan. However, when the rectifying member is positioned above the paper bundle placed on the paper feed tray, the rectifying member may become an obstacle when the paper feed tray is taken out for refilling paper or the like.

BRIEF DESCRIPTION OF THE DRAWINGS

FIG. 21(A) is a side view showing an initial position of the paper feed tray. FIG. 21(B) is a side view showing a state in which the paper feed tray has been moved to a position downstream of the initial position in the tray pull-out direction. FIG. 21(C) is a side view showing a state in which the paper feed tray has been moved to a position downstream of the position in FIG. 21(B) in the tray pull-out direction. FIG. 21(D) is a side view showing a state in which the paper feed tray has been moved to a position downstream of the position in FIG. 21(C) in the tray pull-out direction. FIG. 21(E) is a side view showing a state in which the paper feed tray has been moved to a position downstream of the position in FIG. 21(D) in the tray pull-out direction.

FIG. 22(A) is a side view showing a state in which the paper feed tray has been moved to a position downstream of the position in FIG. 21(E) in the tray pull-out direction. FIG. 22(B) is a side view showing a state in which the paper feed tray has been moved to a position downstream of the position in FIG. 22(A) in the tray pull-out direction. FIG. 22(C) is a side view showing a state in which the paper feed tray has been moved to a position downstream of the position in FIG. 22(B) in the tray pull-out direction. FIG. 22(D) is a side view showing a state in which the paper feed tray has been moved to a position downstream of the position in FIG. 22(C) in the tray pull-out direction. FIG. 22(E) is a side view showing a state in which the paper feed tray has been moved to a position downstream of the position in FIG. 22(D) in the tray pull-out direction.

FIG. 23(A) is a side view showing a taken-out position of the paper feed tray. FIG. 23(B) is a side view showing a state in which the paper feed tray has been moved to a position downstream of the position in FIG. 23(A) in the tray push-in direction. FIG. 23(C) is a side view showing a state in which the paper feed tray has been moved to a position downstream of the position in FIG. 23(B) in the tray push-in direction. FIG. 23(D) is a side view showing a state in which the paper feed tray has been moved to a position downstream of the position in FIG. 23(C) in the tray push-in direction. FIG. 23(E) is a side view showing a state in which the paper feed tray has been moved to a position downstream of the position in FIG. 23(D) in the tray push-in direction.

FIG. 24(A) is a side view showing a state in which the paper feed tray has been moved to a position downstream of the position in FIG. 23(E) in the tray push-in direction. FIG. 24(B) is a side view showing a state in which the paper feed tray has been moved to a position downstream of the position in FIG. 24(A) in the tray push-in direction. FIG. 24(C) is a side view showing a state in which the paper feed tray has been moved to a position downstream of the position in FIG. 24(B) in the tray push-in direction. FIG. 24(D) is a side view showing a state in which the paper feed tray has been moved to a position downstream of the position in FIG. 24(C) in the tray push-in direction. FIG. 24(E) is a side view showing a state in which the paper feed tray has been moved to a position downstream of the position in FIG. 24(D) in the tray push-in direction.

FIG. 25(A) is a side view showing an initial position of a paper feed tray. FIG. 25(B) is a side view showing a state in which the paper feed tray has been moved to a position downstream of the initial position in a tray pull-out direction.

FIG. 27(A) is a side view showing an initial position of a paper feed tray. FIG. 27(B) is a side view showing a state in which the paper feed tray has been moved to a position downstream of the initial position in a tray pull-out direction.

DETAILED DESCRIPTION

A paper feeding device according to an embodiment has a paper feed tray, a device body, a fan, a rectifying member, and a retreat mechanism. A paper bundle in which a plurality of sheets of paper are stacked can be placed on the paper feed tray. The device body includes an accommodating part capable of accommodating the paper feed tray. The fan can generate airflow. The rectifying member is positioned above the paper bundle placed on the paper feed tray in a state in which the paper feed tray is accommodated in the accommodating part. The rectifying member generates a negative pressure between the rectifying member and an uppermost sheet of paper of the paper bundle using the airflow from the fan in a state in which the paper feed tray is accommodated in the accommodating part. The retreat mechanism displaces the rectifying member in conjunction with the paper feed tray so that the rectifying member retreats from the paper feed tray in at least one of a pull-out operation and a push-in operation of the paper feed tray.

Hereinafter, a paper feeding device of a first embodiment will be described with reference to the drawings. In each of the drawings, the same components are denoted by the same references.

The paper feeding device will be described.

Figure 1:
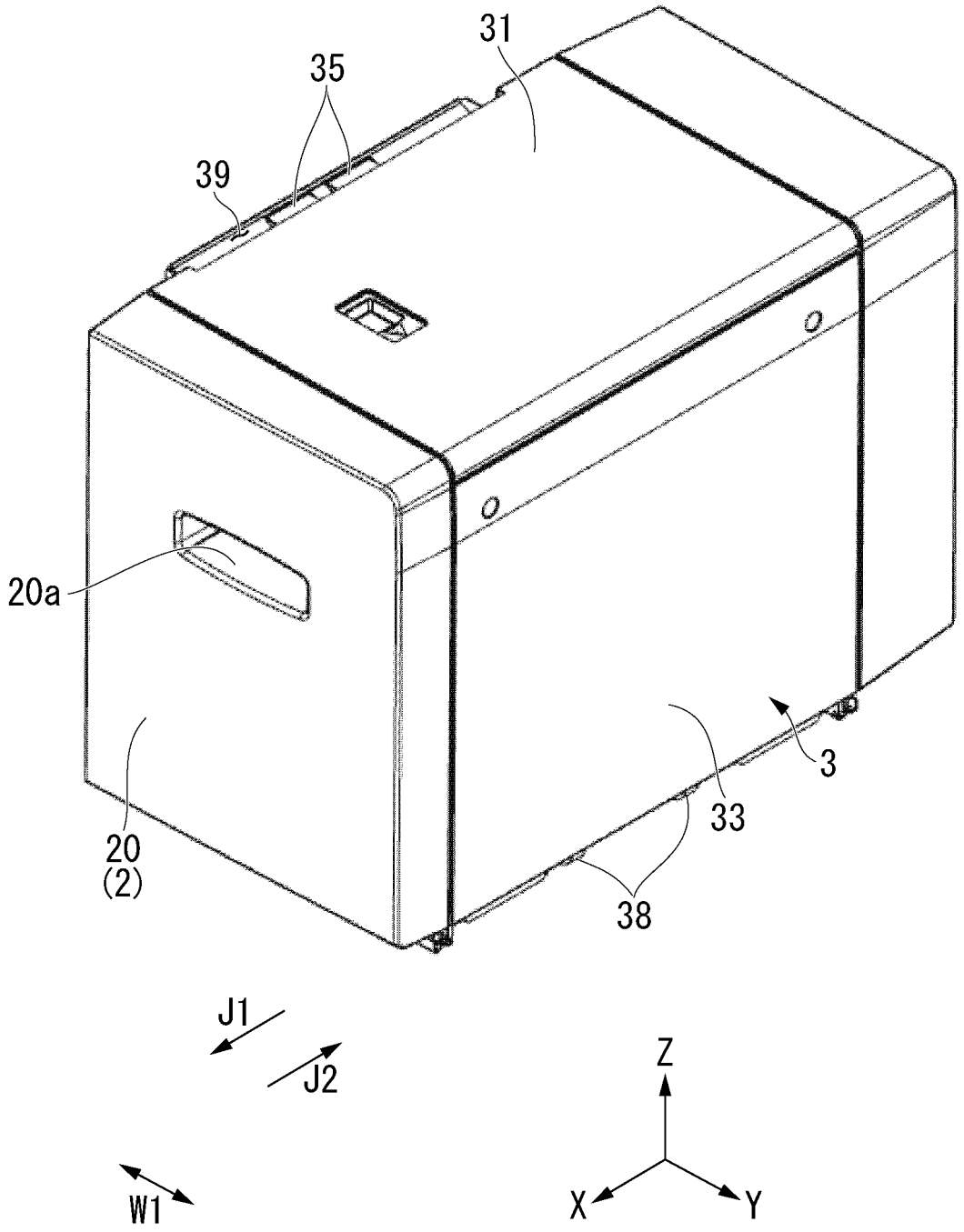
FIG. 1 is a perspective view showing a paper feeding device of a first embodiment.
Figure 2:
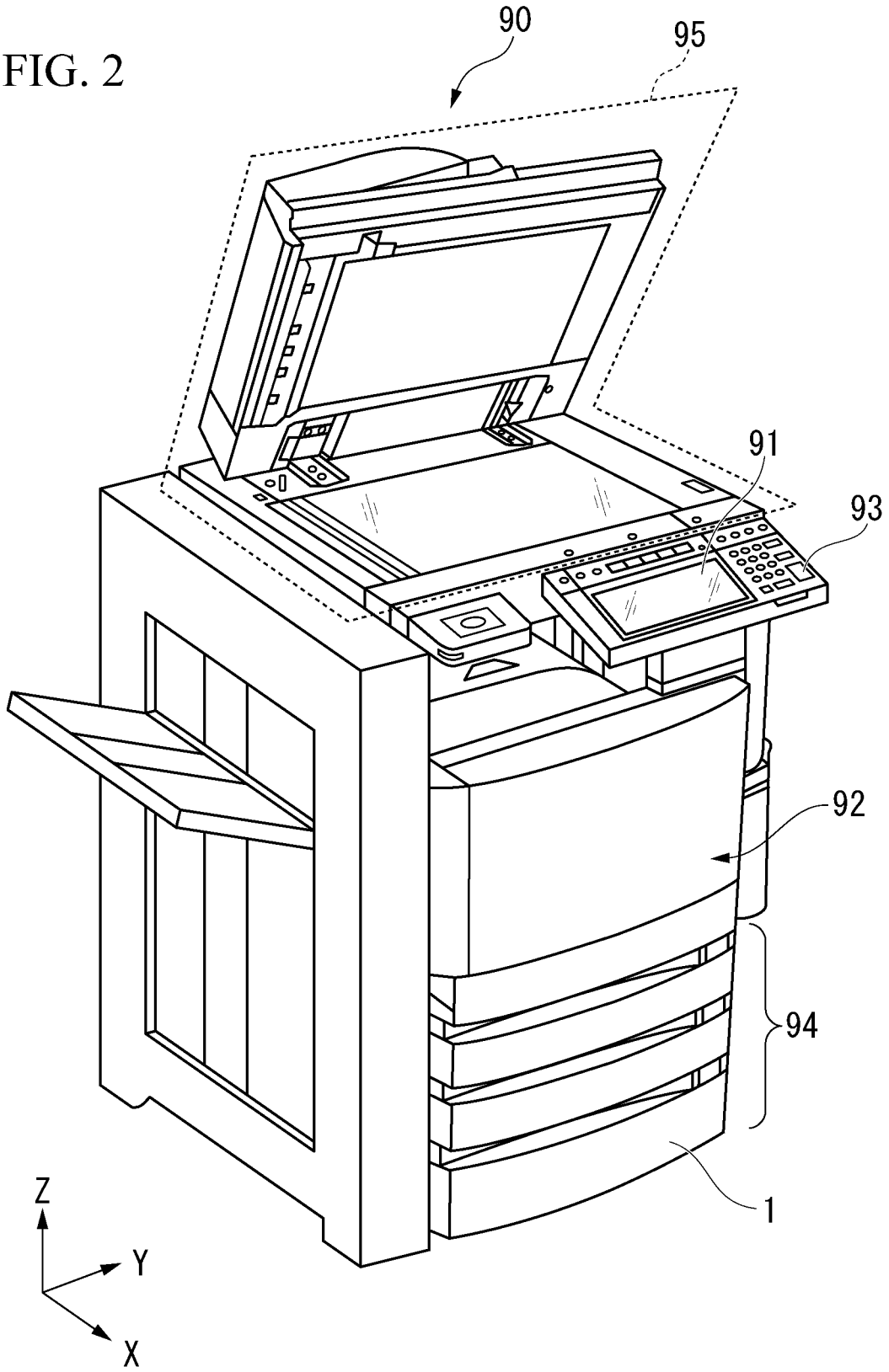
FIG. 2 is a perspective view showing an image forming device to which the paper feeding device of the first embodiment is adjacent.

FIG. 1 is a perspective view showing a paper feeding device 1 of the first embodiment. FIG. 2 is a perspective view showing an image forming device 90 to which the paper feeding device 1 of the first embodiment is adjacent. The following description will use an X, Y, Z orthogonal coordinate system as necessary. A predetermined direction in a horizontal plane is referred to as an X direction, a direction perpendicular to the X direction in the horizontal plane is referred to as a Y direction, and a direction perpendicular to both the X and Y directions (that is, a vertical direction) is referred to as a Z direction. In the X direction, the Y direction, and the Z direction, an arrow direction in the drawing is referred to as a positive (+) direction, and a direction opposite to the arrow is referred to as a negative (−) direction. The +X direction is forward, the −X direction is rearward, the +Y direction is right, the −Y direction is left, the +Z direction is upward, and the −Z direction is downward.

Figure 10:
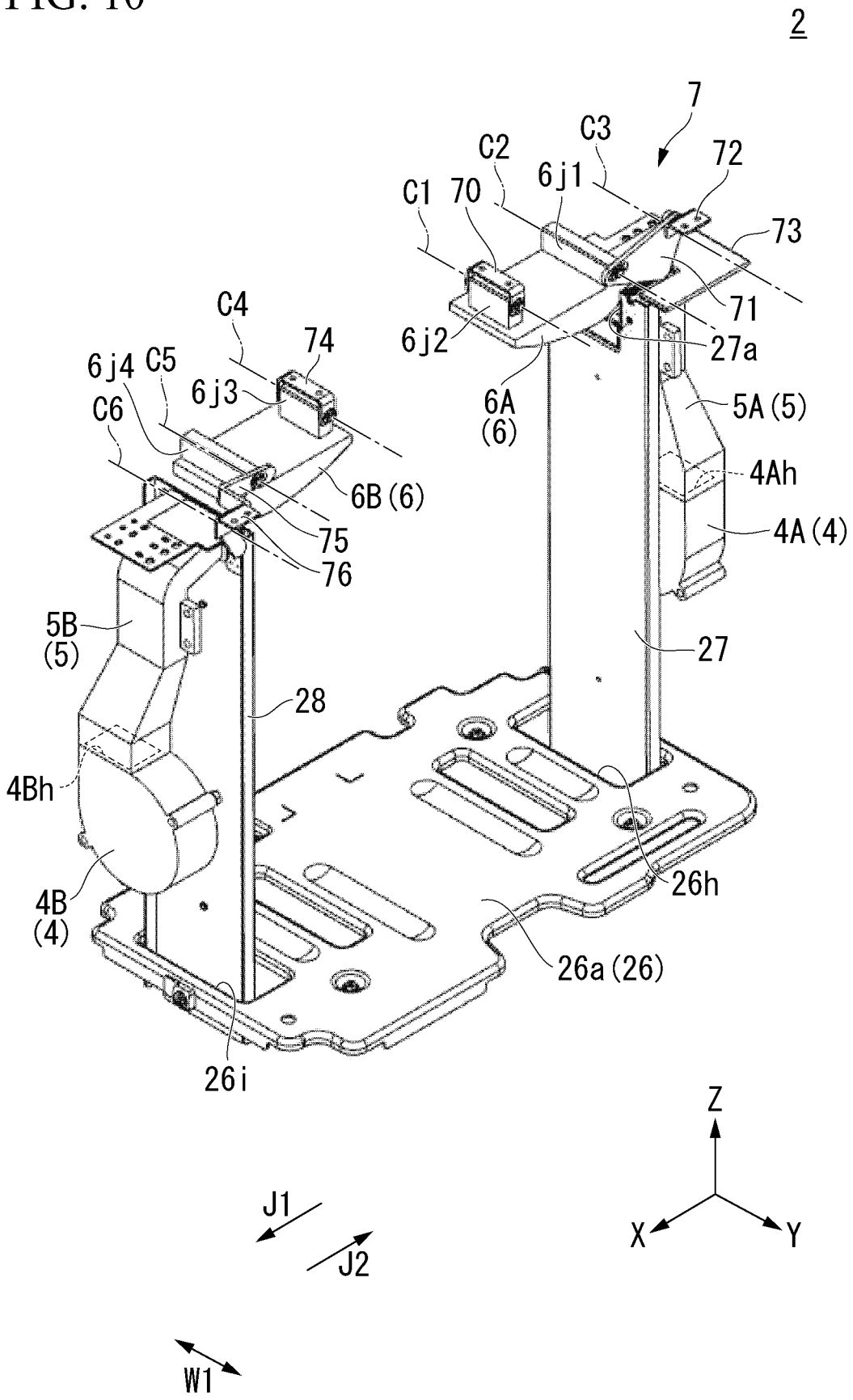
FIG. 10 is a perspective view showing a main part of the paper feed tray of the first embodiment.

As shown in FIG. 1, the paper feeding device 1 includes a paper feed tray 2, a device body 3, a fan 4, a duct 5, a rectifying member 6, and a retreat mechanism 7 (see FIG. 10). For example, the paper feeding device 1 may be disposed adjacent to the image forming device 90 (see FIG. 2) such as a printer.

The image forming device 90 will be described.

The image forming device 90 may be, for example, a multi-function printer (MFP). For example, the image forming device 90 forms an image on paper using a developer such as toner. For example, paper or label paper may be included in the above-described paper. The paper may be anything as long as an image can be formed on its surface. In the example of FIG. 2, the image forming device 90 includes a display 91, a printing unit 92, a control panel unit 93, a paper accommodating unit 94, and an image reading unit 95. The paper accommodating unit 94 includes a multi-level cassette aligned in a vertical direction (Z direction). For example, the paper feeding device 1 of the embodiment is disposed adjacent to a side portion (side portion in the +Y direction) of the paper accommodating unit 94. The paper feeding device 1 of the embodiment functions as a large-capacity expansion unit for expanding a paper accommodating capacity of the paper accommodating unit 94 of the image forming device 90.

The paper feed tray 2 will be described.

Figure 7:
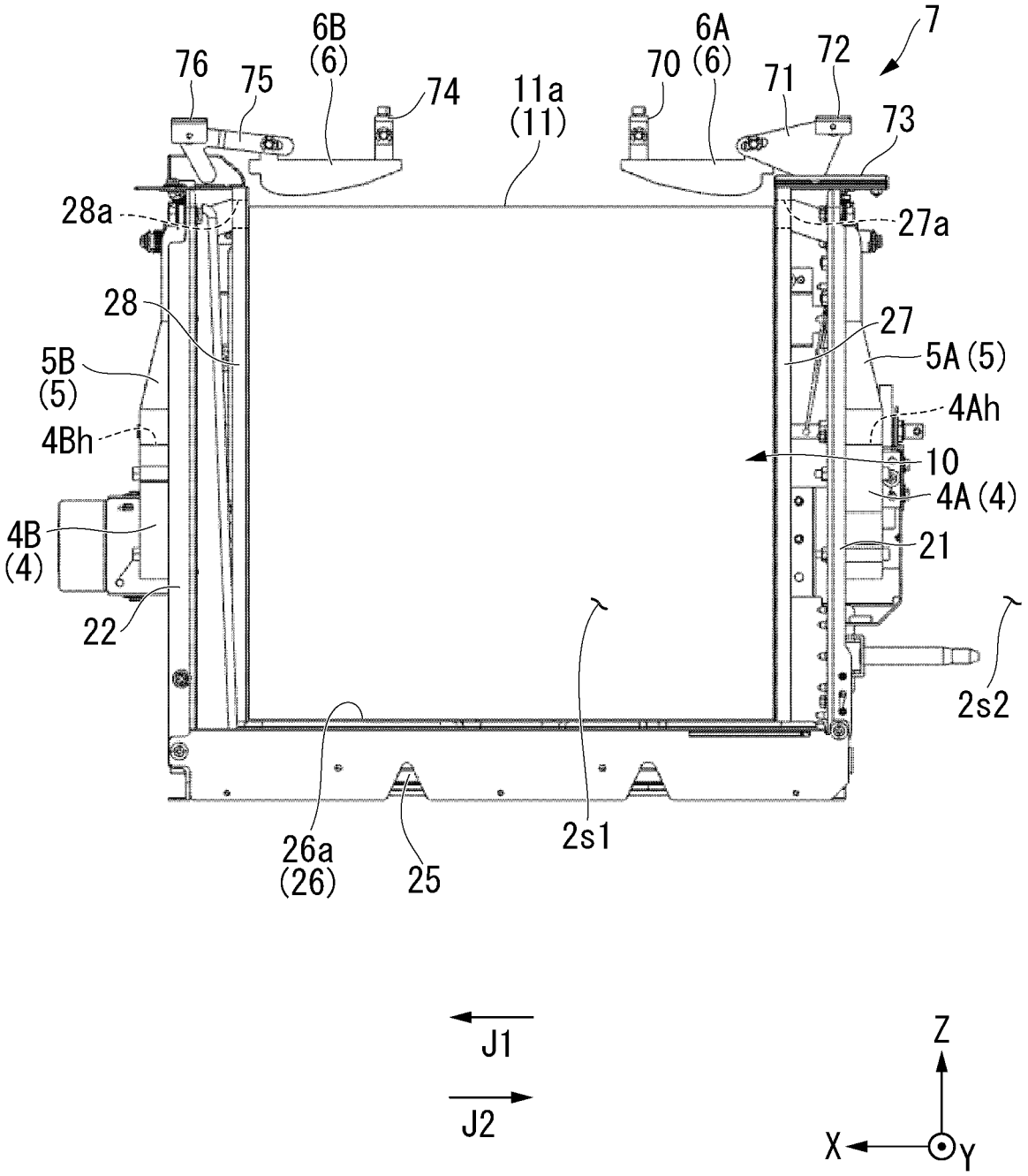
FIG. 7 is a side view of the paper feed tray of the first embodiment.

As shown in FIG. 7, a paper bundle 10 in which a plurality of sheets of paper are stacked can be placed on the paper feed tray 2. For example, a paper bundle 10 in which several thousand sheets of paper are stacked can be placed on the paper feed tray 2. The paper is a sheet shaped recording medium. The paper feed tray 2 supports the paper bundle 10 from below. The paper feed tray 2 surrounds the paper bundle 10. The paper feed tray 2 has a box shape which opens upward. The paper feed tray 2 has an outer shape corresponding to a plurality of paper sizes.

The paper feed tray 2 can be pulled out of the device body 3 in an arrow J1 direction (see FIG. 1). Hereinafter, the arrow J1 direction is also referred to as "tray pull-out direction J1." The paper feed tray 2 has a longitudinal dimension in the tray pull-out direction J1. In the drawing, an arrow J2 indicates a direction opposite to the tray pull-out direction J1 (hereinafter also referred to as "tray push-in direction J2"), and an arrow W1 indicates a device width direction which is perpendicular to the tray pull-out direction J1 and parallel to a paper loading surface 26*a* (see FIG. 4).

Figure 4:
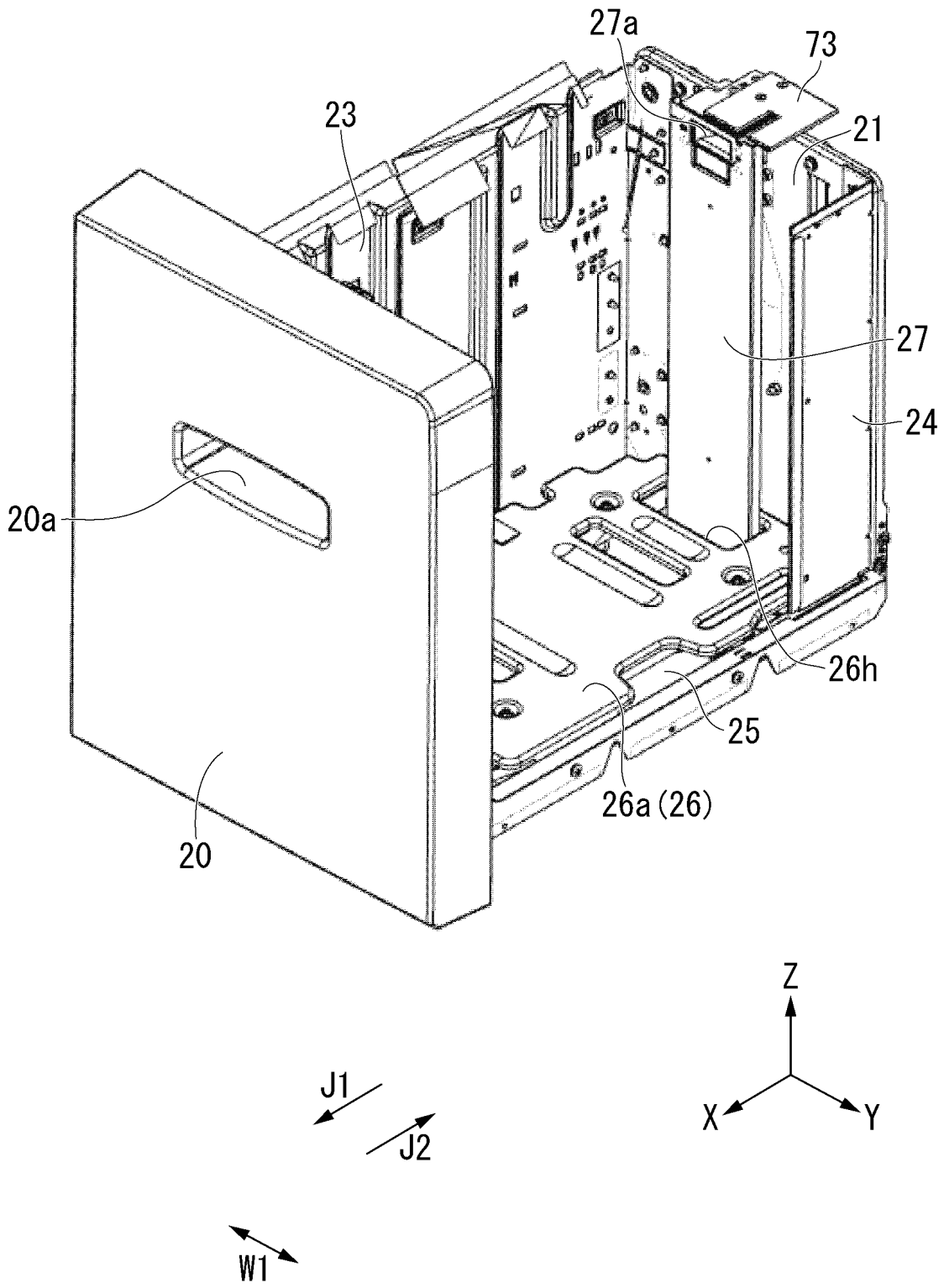
FIG. 4 is a perspective view of a paper feed tray of the first embodiment.
Figure 5:
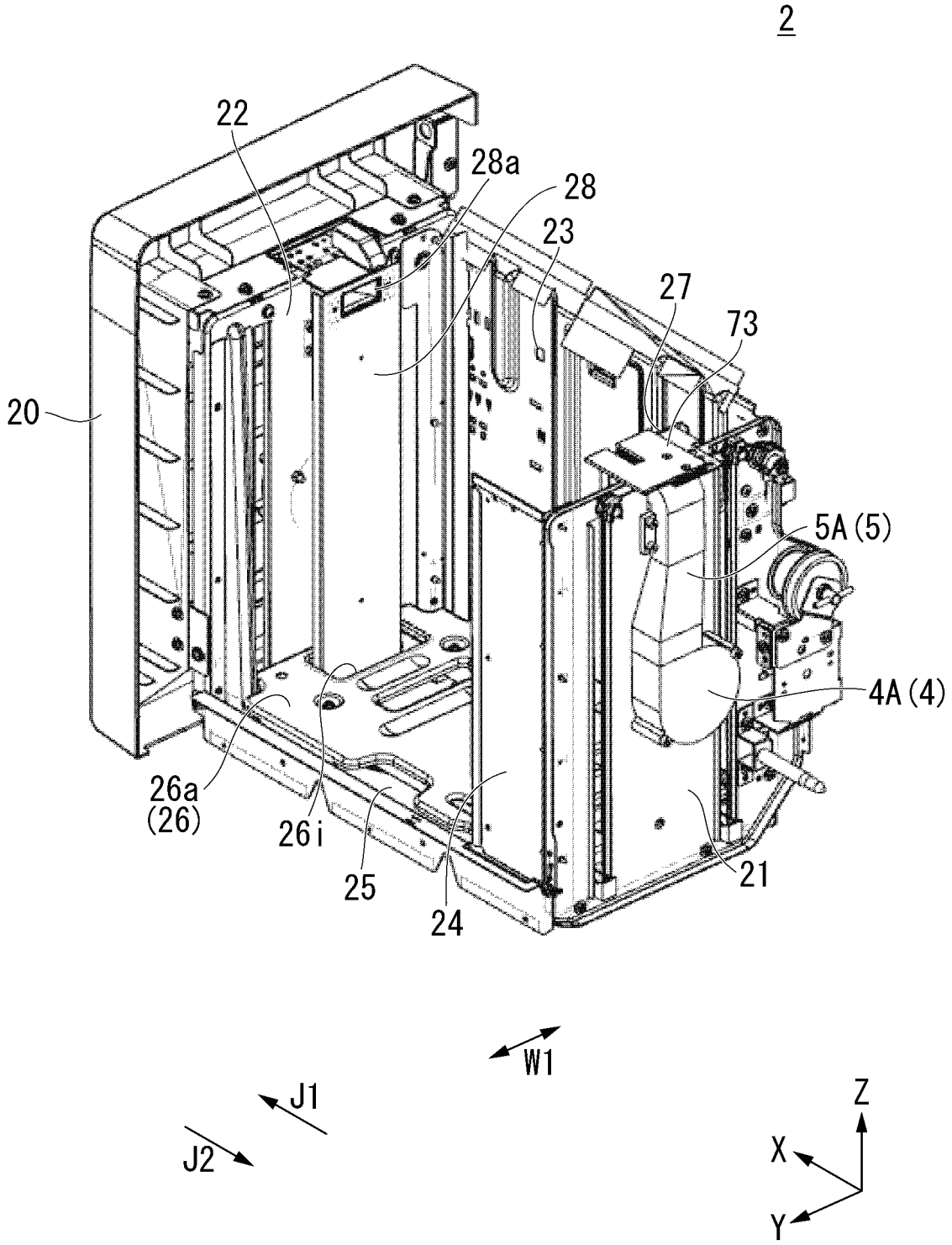
FIG. 5 is a perspective view of the paper feed tray of the first embodiment when viewed from a side opposite to FIG. 4.

As shown in FIG. 4, the paper feed tray 2 includes a lid portion 20, a first side portion 21, a second side portion 22 (see FIG. 5), a third side portion 23, a fourth side portion 24, a bottom portion 25, a paper loading part 26, a first tray side plate 27, and a second tray side plate 28 (see FIG. 5).

The lid portion 20 constitutes a downstream end portion in the tray pull-out direction J1 of the paper feed tray 2. In other words, the lid portion 20 constitutes an upstream end portion in the tray push-in direction J2 of the paper feed tray 2. The lid portion 20 closes an accommodating part 30 in a state in which the paper feed tray 2 is accommodated in the accommodating part 30 of the device body 3 (see FIG. 3). The lid portion 20 has a rectangular outer shape. The lid portion 20 has a gripping portion 20*a* that can be gripped by a user.

The first side portion 21 constitutes an upstream end portion in the tray pull-out direction J1 of the paper feed tray 2. The first side portion 21 has an outer shape smaller than that of the lid portion 20.

The second side portion 22 (see FIG. 5) is positioned on a side opposite to the first side portion 21 in the tray pull-out direction J1. The second side portion 22 faces the first side portion 21 with the paper loading part 26 therebetween.

The third side portion 23 constitutes one side portion (left side portion) of the paper feed tray 2 in the device width direction W1. The third side portion 23 is connected to the first side portion 21, the second side portion 22, and the bottom portion 25.

The fourth side portion 24 is positioned on a side (right side) opposite to the third side portion 23 in the device width direction W1. The fourth side portion 24 is disposed to be spaced apart from the second side portion 22 (see FIG. 5). The fourth side portion 24 is connected to the first side portion 21 and the bottom portion 25. The fourth side portion 24 faces the third side portion 23 with the paper loading part 26 (the first tray side plate 27) therebetween.

The bottom portion 25 constitutes a lowermost portion of the paper feed tray 2.

The paper loading part 26 is disposed on an upper surface of the bottom portion 25. The paper loading part 26 includes the loading surface 26*a* (upper surface) on which the paper bundle 10 can be placed. The paper loading part 26 includes a first insertion hole 26*h* and a second insertion hole 26*i*. The first insertion hole 26*h* is positioned close to the first side portion 21. The second insertion hole 26*i* is positioned close to the second side portion 22.

The first tray side plate 27 is disposed at an upstream end portion in the tray pull-out direction J1 of the paper feed tray 2. The first tray side plate 27 is positioned at a central portion of the paper feed tray 2 in the device width direction W1 (see FIG. 6). The first tray side plate 27 extends in the vertical direction. The first tray side plate 27 is in contact with the paper bundle 10 from the rear (upstream side in the tray pull-out direction J1) of the paper bundle 10 to function as an aligning member for positioning the paper bundle 10 in the tray pull-out direction J1 (see FIG. 7).

As shown in FIG. 7, the first tray side plate 27 includes a blowing port 27*a* (hereafter, also referred to as "first blowing port 27*a*") which opens such that airflow from a first fan 4A flows between an upper surface of an uppermost sheet of paper 11 and a lower surface of a first rectifying member 6A. The first blowing port 27*a* is positioned at an upper end portion of the first tray side plate 27. The first blowing port 27*a* is positioned at a central portion of the uppermost sheet of paper 11 in the device width direction W1 (see FIG. 6).

The second tray side plate 28 is disposed at a downstream end portion in the tray pull-out direction J1 of the paper feed tray 2. The second tray side plate 28 is positioned at a central portion of the paper feed tray 2 in the device width direction W1 (see FIG. 6). The second tray side plate 28 extends in the vertical direction. The second tray side plate 28 is in contact with the paper bundle 10 from the front (downstream side in the tray pull-out direction J1) of the paper bundle 10 to function as an aligning member for positioning the paper bundle 10 in the tray pull-out direction J1.

The second tray side plate 28 includes a blowing port 28*a* (hereafter, also referred to as "second blowing port 28*a*") which opens such that airflow from a second fan 4B flows between an upper surface of the uppermost sheet of paper 11 and a lower surface of a second rectifying member 6B. The second blowing port 28*a* is positioned at an upper end portion of the second tray side plate 28. The second blowing port 28*a* is positioned at a central portion of the uppermost sheet of paper 11 in the device width direction W1 (see FIG. 6).

The device body 3 will be described.

Figure 3:
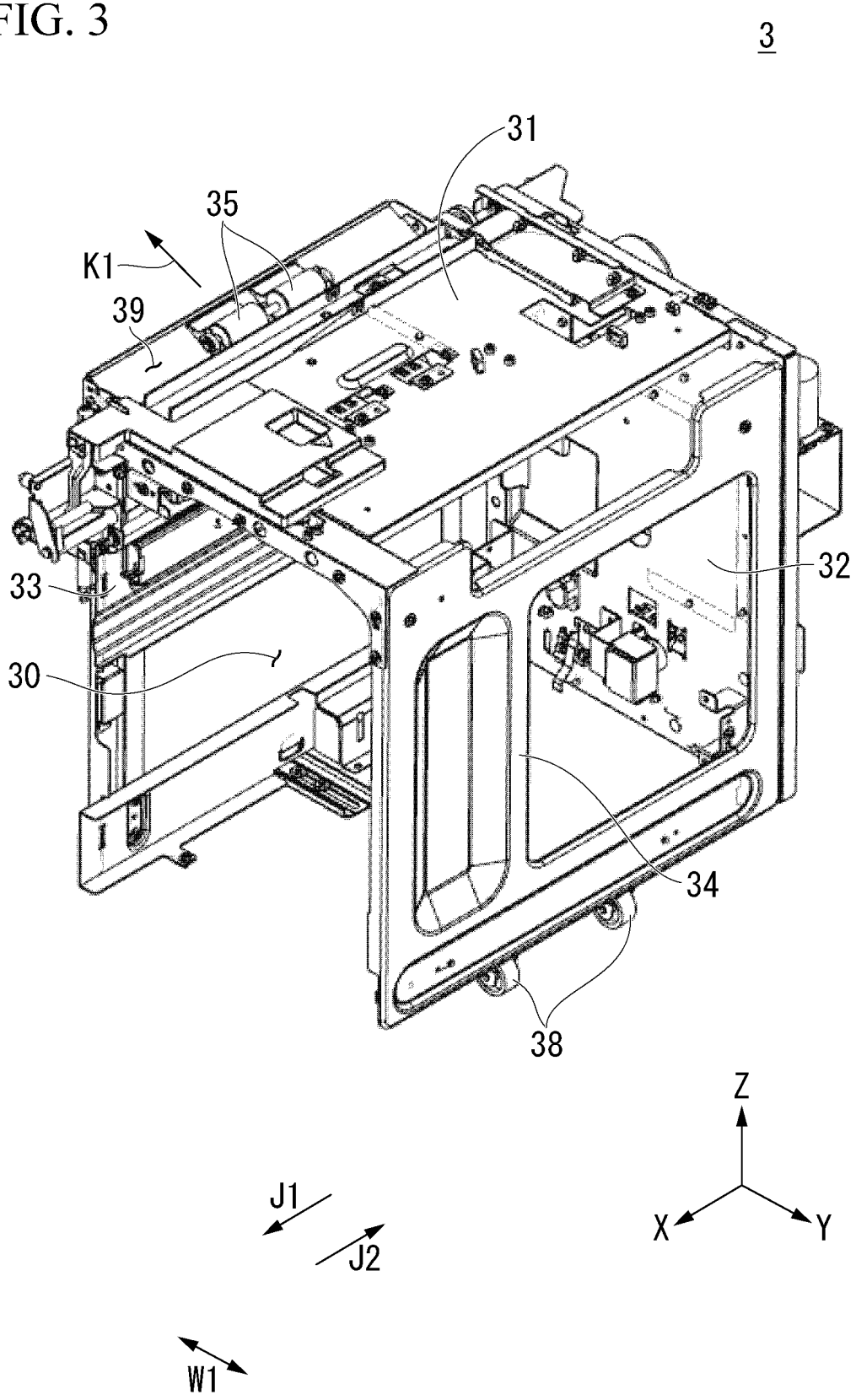
FIG. 3 is a perspective view showing a device body of the first embodiment.

As shown in FIG. 3, the device body 3 includes the accommodating part 30 capable of accommodating the paper feed tray 2 (see FIG. 4). The device body 3 has a box shape which opens in the tray pull-out direction J1 (forward). Reference 38 in the drawing denotes casters which movably support the device body 3.

The device body 3 includes a top wall 31, a first side wall 32, a second side wall 33, a third side wall 34, and a pickup roller 35.

The top wall 31 constitutes an uppermost portion (ceiling portion) of the device body 3. The top wall 31 extends in the tray pull-out direction J1.

The first side wall 32 constitutes an upstream end portion (rear end portion) in the tray pull-out direction J1 of the device body 3. The first side wall 32 is connected to an upstream end portion in the tray pull-out direction J1 of the top wall 31.

The second side wall 33 constitutes one side portion (left side portion) of the device body 3 in the device width direction W1. The second side wall 33 is connected to one end portion of the first side wall 32 in the device width direction W1.

The third side wall 34 constitutes the other side portion (right side portion) of the device body 3 in the device width direction W1. The third side wall 34 is connected to the other end portion of the first side wall 32 in the device width direction W1.

The pickup roller 35 is a roller for feeding unused paper placed on the paper feed tray 2 (see FIG. 4). Reference 39 in the drawing indicates a gap formed between an upper end portion of the second side wall 33 and the top wall 31. The pickup roller 35 takes paper from the paper feed tray 2 through the gap 39. The pickup roller 35 is positioned at a downstream end portion of the device body 3 in a paper conveying direction K1. The pickup roller 35 is in contact with an upper surface 21*a* (see FIG. 7) of the paper bundle 10 placed on the paper feed tray 2. The pickup roller 35 is connected to a drive mechanism (not shown) including a motor and the like. When the pickup roller 35 rotates due to an operation of the drive mechanism, paper is fed out of the paper feed tray 2. The fed-out paper is supplied to the image forming device 90 (see FIG. 2).

The fan 4 will be described.

The fan 4 can generate airflow. In the embodiment, a plurality of (for example, two) fans 4 are provided. As shown in FIG. 7, the fans 4 are fixed to side portions on a side opposite to the paper loading part 26 in the paper feed tray 2. Hereinafter, the fan 4 fixed to the first side portion 21 of the paper feed tray 2 is referred to as "first fan 4A," and the fan 4 fixed to the second side portion 22 of the paper feed tray 2 is referred to as "second fan 4B."

The first fan 4A includes a blow-off outlet 4Ah which opens toward the first blowing port 27*a*. The blow-off outlet 4Ah of the first fan 4A opens upward.

The second fan 4B includes a blow-off outlet 4Bh which opens toward the second blowing port 28*a*. The blow-off outlet 4Bh of the second fan 4A opens upward.

The duct 5 will be described.

In the embodiment, a plurality of (for example, two) ducts 5 are provided. The ducts 5 are connected to the fans 4. Hereinafter, the duct 5 connected to the first fan 4A is referred to as "first duct 5A," and the duct 5 connected to the second fan 4B is referred to as "second duct 5B."

The first duct 5A is fixed to the first side portion 21 of the paper feed tray 2. The first duct 5A connects the upper end portion of the first tray side plate 27 to the first fan 4A so that airflow from the blow-off outlet 4Ah of the first fan 4A flows toward the first blowing port 27*a*.

The second duct 5B is fixed to the second side portion 22 of the paper feed tray 2. The second duct 5B connects the upper end portion of the second tray side plate 28 to the second fan 4B so that airflow from the blow-off outlet 4Bh of the second fan 4B flows toward the second blowing port 28*a*.

The rectifying member 6 will be described.

As shown in FIG. 7, the rectifying member 6 is positioned above the paper bundle 10 placed on the paper feed tray 2 in a state in which the paper feed tray 2 is accommodated in the accommodating part 30 (refer to FIG. 3) of the device body 3 (hereinafter also referred to as "tray accommodated state"). In the tray accommodated state, the rectifying member 6 generates a negative pressure between the rectifying member 6 and the uppermost sheet of paper 11 of the paper bundle 10 using the airflow from the fan 4. In the embodiment, a plurality of (for example, two) rectifying members 6 are disposed above the paper bundle 10 placed on the paper feed tray 2. The rectifying members 6 are connected to the top wall 31 (see FIG. 3) of the device body 3. Hereinafter, the rectifying member 6 disposed on an upstream portion in the tray pull-out direction J1 of the top wall 31 (see FIG. 3) is referred to as "first rectifying member 6A," and the rectifying member 6 disposed on a downstream portion in the tray pull-out direction J1 of the top wall 31 (see FIG. 3) is referred to as "second rectifying member 6B."

The first rectifying member 6A is positioned on the first fan 4A side in the tray accommodated state. The first rectifying member 6A is positioned above the uppermost sheet of paper 11 in the tray accommodated state. In the tray accommodated state, the first rectifying member 6A generates a negative pressure between the first rectifying member 6A and the uppermost sheet of paper 11 using the airflow from the first fan 4A. A lowermost surface of the first rectifying member 6A is positioned below an upper end of the first blowing port 27*a*.

The second rectifying member 6B is positioned on the second fan 4B side in the tray accommodated state. The second rectifying member 6B is positioned above the uppermost sheet of paper 11 in the tray accommodated state. The second rectifying member 6B is disposed downstream of the first rectifying member 6A in the tray pull-out direction J1. In the tray accommodated state, the second rectifying member 6B generates a negative pressure between the second rectifying member 6B and the uppermost sheet of paper 11 using the airflow from the second fan 4B. A lowermost surface of the second rectifying member 6B is positioned below an upper end of the second blowing port 28*a*.

Figure 6:
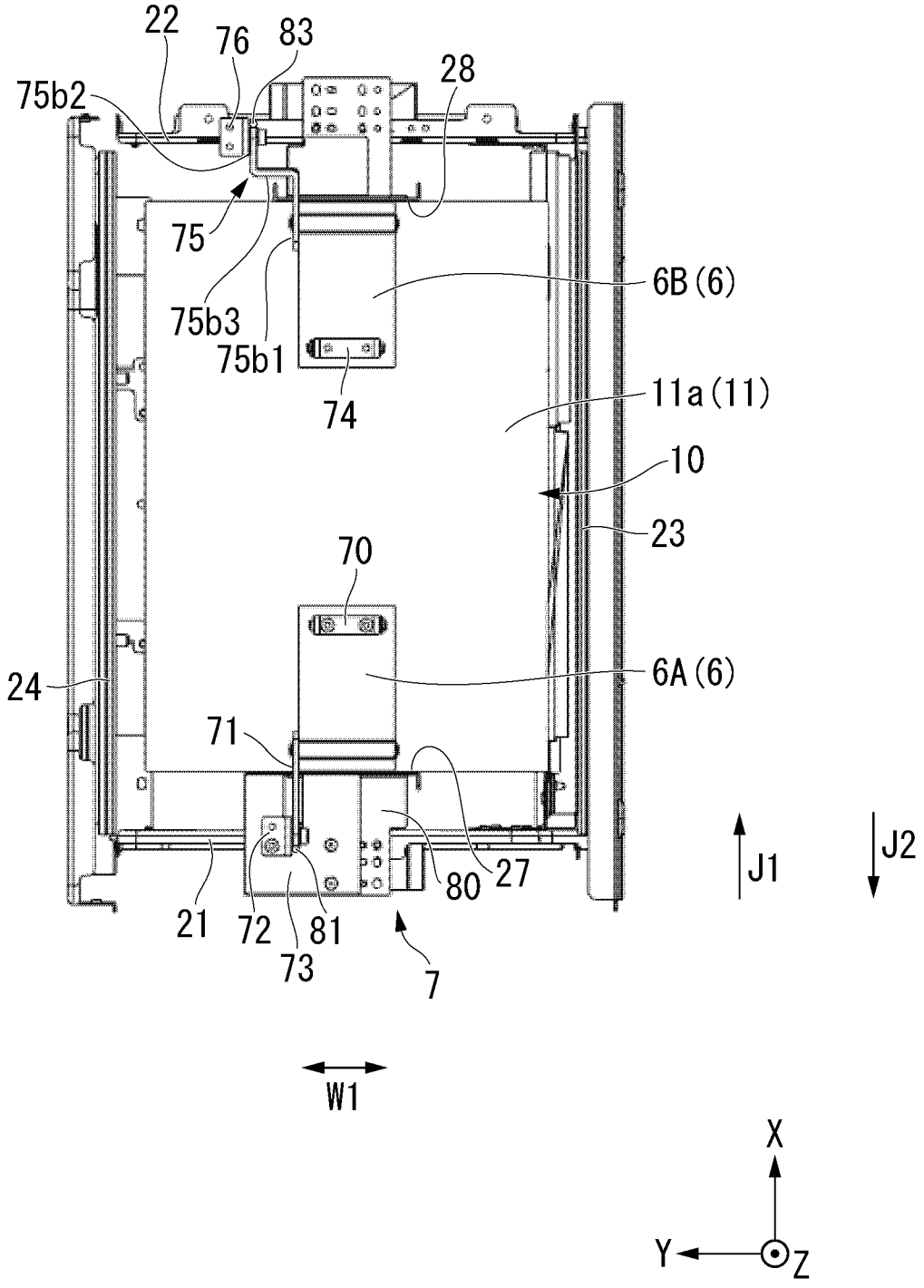
FIG. 6 is a top view of the paper feed tray of the first embodiment.

The rectifying member 6 has an airfoil shape. For example, the rectifying member 6 may have a shape which is inverted upside down from a wing (main wing) of an airplane. The rectifying member 6 has a continuous airfoil shape with no gaps. As shown in FIG. 6, the rectifying member 6 has a fixed length in the device width direction W1. The rectifying member 6 extends in a direction parallel to the upper surface 21*a* of the uppermost sheet of paper 11. The rectifying member 6 continuously extends in the device width direction W1.

Figure 8:
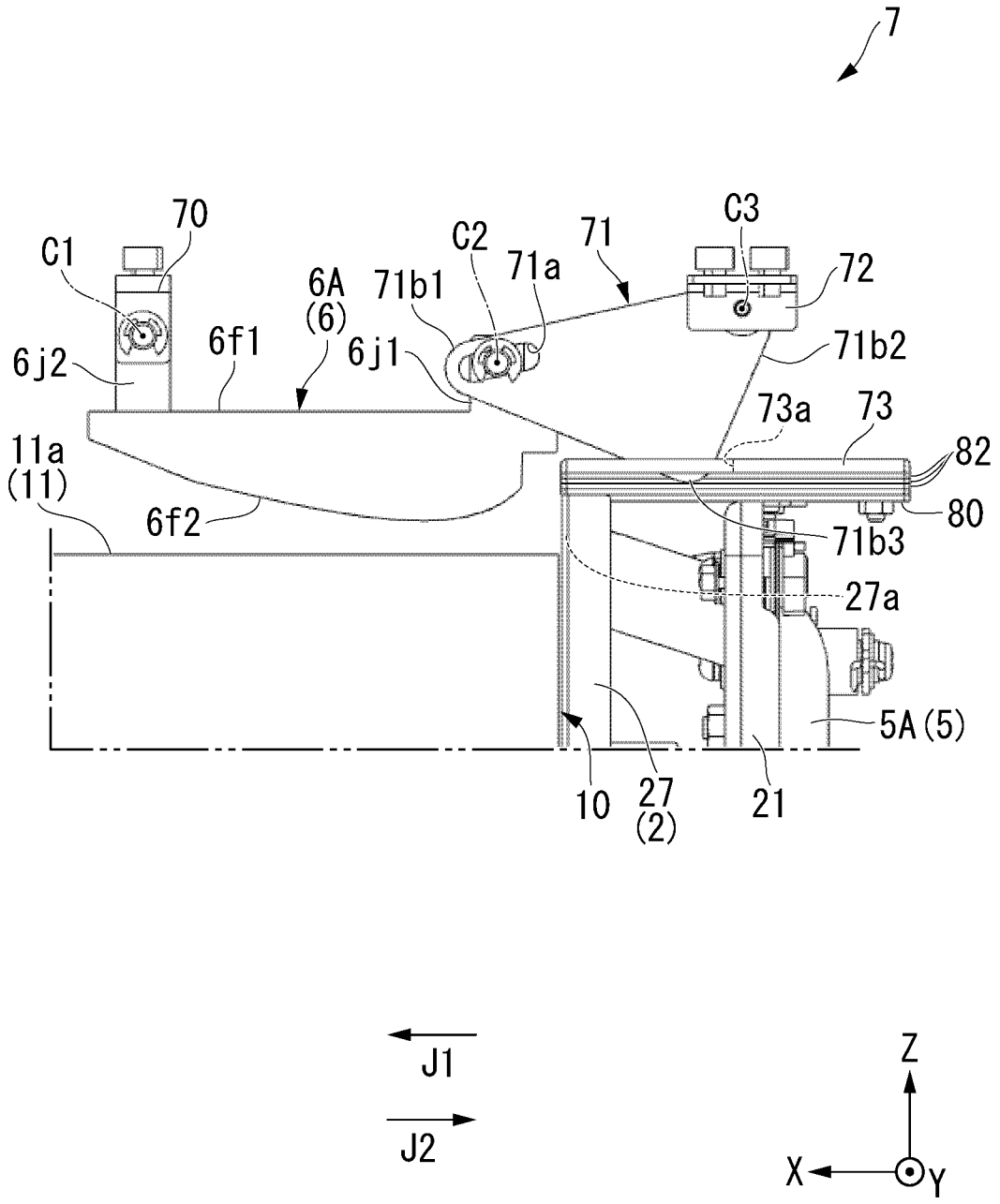
FIG. 8 is an enlarged view showing a main part of FIG. 7 and is a side view showing an upstream portion in a tray pull-out direction of a retreat mechanism.

As shown in FIG. 8, the rectifying member 6 is disposed to be spaced apart from the uppermost sheet of paper 11 of the paper bundle 10. A lower portion of the rectifying member 6 faces the upper surface 21*a* of the uppermost sheet of paper 11. The rectifying member 6 has an upper surface 6*f*1 having a substantially horizontal linear shape. The rectifying member 6 has a lower surface 6*f*2 that is curved to be convex downward (hereinafter also referred to as a "curved lower surface 6*f*2").

The curved lower surface 6*f*2 of the first rectifying member 6A is inclined to be gradually positioned upward with distance from the first blowing port 27*a*. References 6*j*1 and 6*j*2 in the drawing denote a pair of connecting protrusions (a first connecting protrusion and a second connecting protrusion) for connecting the first rectifying member 6A to the top wall 31 of the device body 3 (see FIG. 3). The first connecting protrusion 6*j*1 protrudes upward from an upstream end portion in the tray pull-out direction J1 of the first rectifying member 6A. The second connecting protrusion 6*j*2 protrudes upward from a downstream end portion in the tray pull-out direction J1 of the first rectifying member 6A.

Figure 9:
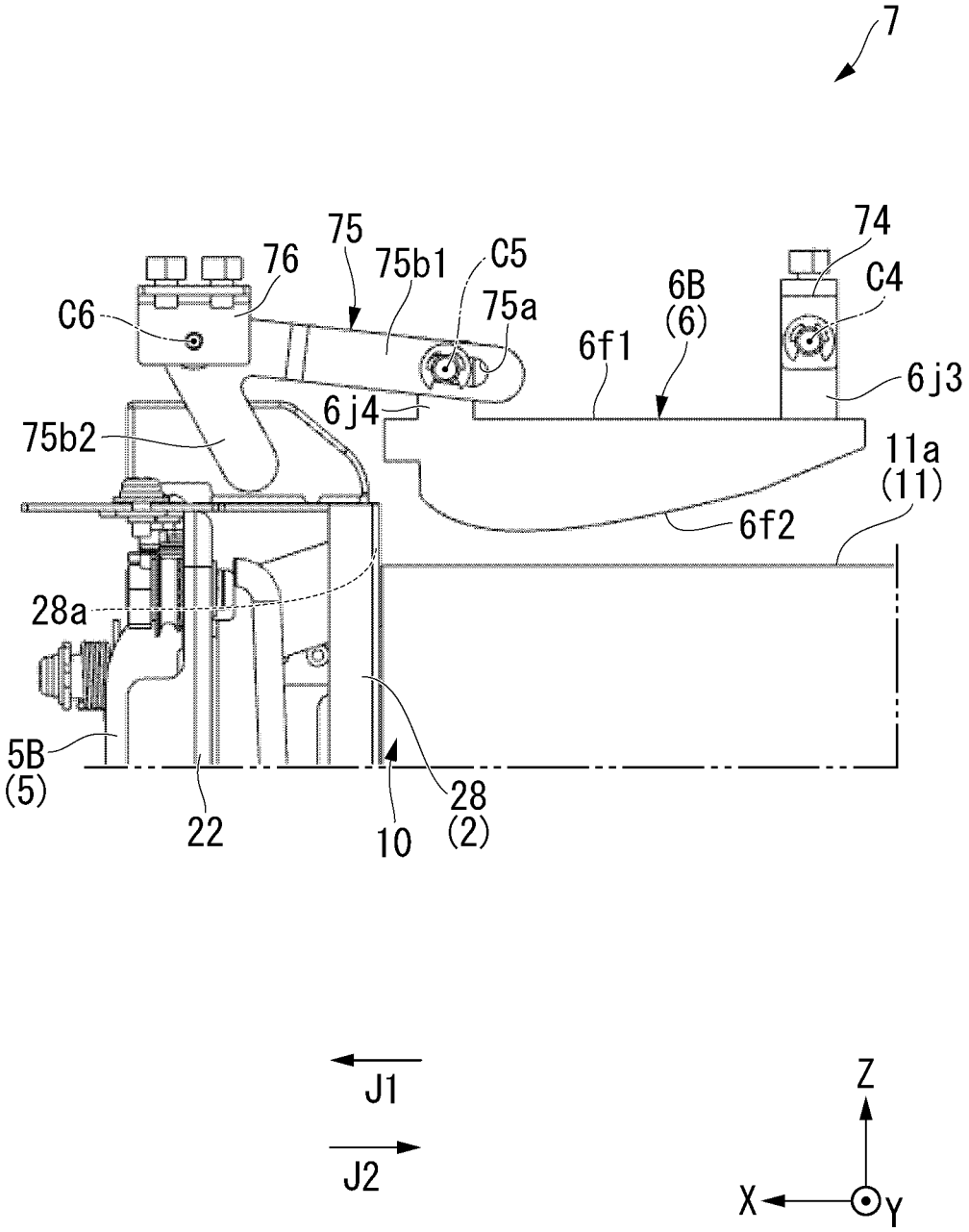
FIG. 9 is an enlarged view showing a main part of FIG. 7 and is a side view showing a downstream portion in the tray pull-out direction of the retreat mechanism.

As shown in FIG. 9, a curved lower surface 6*f*2 of the second rectifying member 6B is inclined to be gradually positioned upward with distance from the second blowing port 28*a*. References 6*j*3 and 6*j*4 in the drawing denote a pair of connecting protrusions (a third connecting protrusion and a fourth connecting protrusion) for connecting the second rectifying member 6B to the top wall 31 of the device body 3 (see FIG. 3). The third connecting protrusion 6*j*3 protrudes upward from an upstream end portion in the tray pull-out direction J1 of the second rectifying member 6B. The fourth connecting protrusion 6*j*4 protrudes upward from a downstream end portion in the tray pull-out direction J1 of the second rectifying member 6B.

The retreat mechanism 7 will be described.

In both a pull-out operation and a push-in operation of the paper feed tray 2, the retreat mechanism 7 displaces each of the first rectifying member 6A and the second rectifying member 6B in conjunction with movement of the paper feed tray 2 so that each of the first rectifying member 6A and the second rectifying member 6B retreats from the paper feed tray 2.

As shown in FIG. 7, the retreat mechanism 7 displaces the rectifying member 6 into an internal space 2*s*1 of the paper feed tray 2 in the tray accommodated state. The internal space 2*s*1 of the paper feed tray 2 is a space defined by the first side portion 21, the second side portion 22, the third side portion 23, and the fourth side portion 24 of the paper feed tray 2 and opening upward. The retreat mechanism 7 displaces the rectifying member 6 to a space between the first side portion 21 and the second side portion 22 of the paper feed tray 2 in the tray accommodated state.

The retreat mechanism 7 displaces the rectifying member 6 to an external space 2*s*2 of the paper feed tray 2 in a state in which the paper feed tray 2 is taken out of the accommodating part 30 (see FIG. 3) (hereinafter also referred to as "tray taken-out state"). The external space 2*s*2 of the paper feed tray 2 is a space outside the space defined by the first side portion 21, the second side portion 22, the third side portion 23, and the fourth side portion 24 of the paper feed tray 2, and opens upward. The retreat mechanism 7 displaces the rectifying member 6 to the outside of the first side portion 21 or the second side portion 22 of the paper feed tray 2 in the tray taken-out state.

The retreat mechanism 7 includes a first support part 70, a first link member 71 (link member), a second support part 72, an abutment member 73, a third support part 74, a second link member 75, and a fourth support part 76. The retreat mechanism 7 is disposed at a position avoiding the blowing ports 27*a* and 28*a*. When the first blowing port 27*a* is viewed from a downstream side (front side) in the tray pull-out direction J1, the retreat mechanism 7 is disposed at a position that does not overlap the first blowing port 27*a*. When the second blowing port 28*a* is viewed from an upstream side (rear side) in the tray pull-out direction J1, the retreat mechanism 7 is disposed at a position that does not overlap the second blowing port 28*a*.

Figure 11:
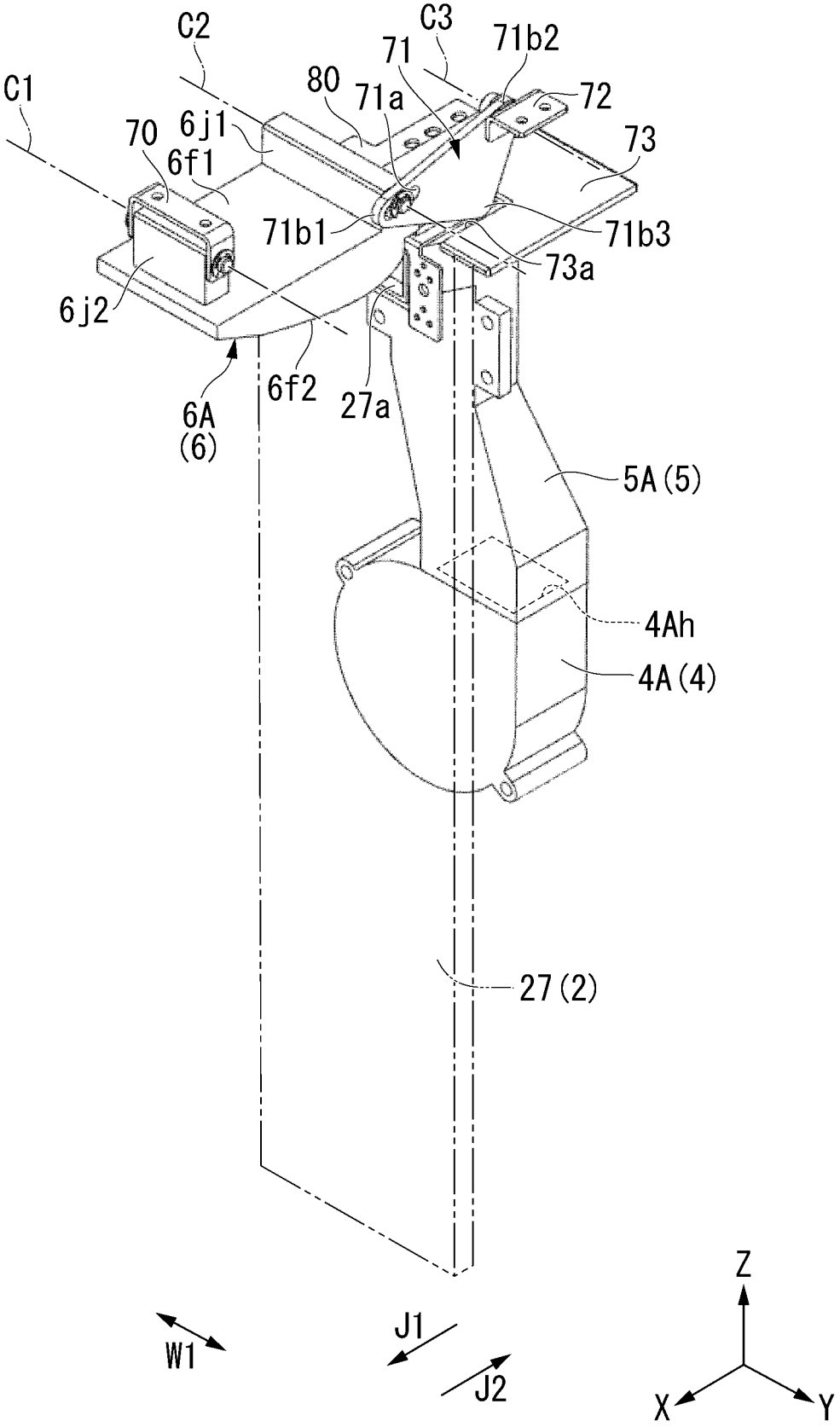
FIG. 11 is an enlarged view showing a main part of FIG. 10 and is a perspective view showing an upstream portion in the tray pull-out direction.

As shown in FIG. 11, the first support part 70 is fixed to the top wall 31 (see FIG. 21(A)) of the device body 3. The first support part 70 supports the first rectifying member 6A to be rotatable around a first axis C1 (an axis substantially parallel to the device width direction W1) in conjunction with the movement of the paper feed tray 2. In the pull-out operation of the paper feed tray 2, the first support part 70 supports the downstream end portion of the first rectifying member 6A to be rotatable around the first axis C1 in the tray pull-out direction J1. On the other hand, in the push-in operation of the paper feed tray 2, the first support part 70 supports the upstream end portion in the tray push-in direction J2 of the first rectifying member 6A to be rotatable around the first axis C1. The first support part 70 has a U shape (inverted U shape) that opens downward to sandwich the second connecting protrusion 6*j*2.

The first link member 71 connects (links) the first rectifying member 6A and the second support part 72 in conjunction with the movement of the paper feed tray 2. The first link member 71 includes a first elongated hole 71*a* (elongated hole) that supports the upstream end portion in the tray pull-out direction J1 of the first rectifying member 6A and a second axis C2 (an axis substantially parallel to the first axis C1) to be displaceable in the pull-out operation of the paper feed tray 2. On the other hand, in the push-in operation of the paper feed tray 2, the first elongated hole 71*a* supports the downstream end portion in the tray push-in direction J2 of the first rectifying member 6A and the second axis C2 to be displaceable.

As shown in FIG. 8, the first link member 71 has a triangular shape which is convex downward. The first link member 71 includes a first corner portion 71*b*1, a second corner portion 71*b*2, and a third corner portion 71*b*3.

The first corner portion 71*b*1 includes the first elongated hole 71*a*. The first elongated hole 71*a* extends along one side (upper side) of the first link member 71.

The second corner portion 71*b*2 is supported to be rotatable around a third axis C3.

The third corner portion 71*b*3 is convex downward.

The second support part 72 is fixed to the top wall 31 (see FIG. 21(A)) of the device body 3. The second support part 72 supports the third corner portion 71*b*3 of the first link member 71 to be rotatable around the third axis C3 (an axis substantially parallel to the first axis C1) in conjunction with the movement of the paper feed tray 2. In the pull-out operation of the paper feed tray 2, the second support part 72 supports an upstream end portion in the tray pull-out direction J1 of the first link member 71 to be rotatable around the third axis C3. On the other hand, in the push-in operation of the paper feed tray 2, the second support part 72 supports a downstream end portion in the tray push-in direction J2 of the first link member 71 to be rotatable around the third axis C3. The second support part 72 has an L shape having a side surface along one surface of the first link member 71 (see FIG. 11).

As shown in FIG. 11, the abutment member 73 is fixed to the upper end portion of the first tray side plate 27 of the paper feed tray 2. In the drawing, reference 80 denotes a fixing plate for fixing the abutment member 73 to the upper end portion of the first tray side plate 27, reference 81 (see FIG. 12) denotes a first stopper for restricting a rotational position of the first link member 71, and reference 82 (see FIG. 8) denotes a spacer for setting a distance between the abutment member 73 and the fixing plate 80 (a position in a vertical direction of the abutment member 73).

The abutment member 73 comes into contact with the first link member 71 or the first rectifying member 6A in conjunction with the movement of the paper feed tray 2.

At the time of the pull-out operation of the paper feed tray 2, the abutment member 73 comes into contact with the third corner portion 71*b*3 (downward-convex portion) of the first link member 71 and rotates the first link member 71 around the third axis C3 so that the second axis C2 is displaced upward. Thereby, the abutment member 73 rotates the first rectifying member 6A around the first axis C1 so that the first rectifying member 6A retreats from the paper feed tray 2.

At the time of the push-in operation of the paper feed tray 2, the abutment member 73 comes into contact with the curved lower surface 6*f*2 of the first rectifying member 6A and rotates the first rectifying member 6A around the first axis C1 so that the second axis C2 is displaced upward. Thereby, the abutment member 73 rotates the first link member 71 around the third axis C3.

Figure 12:
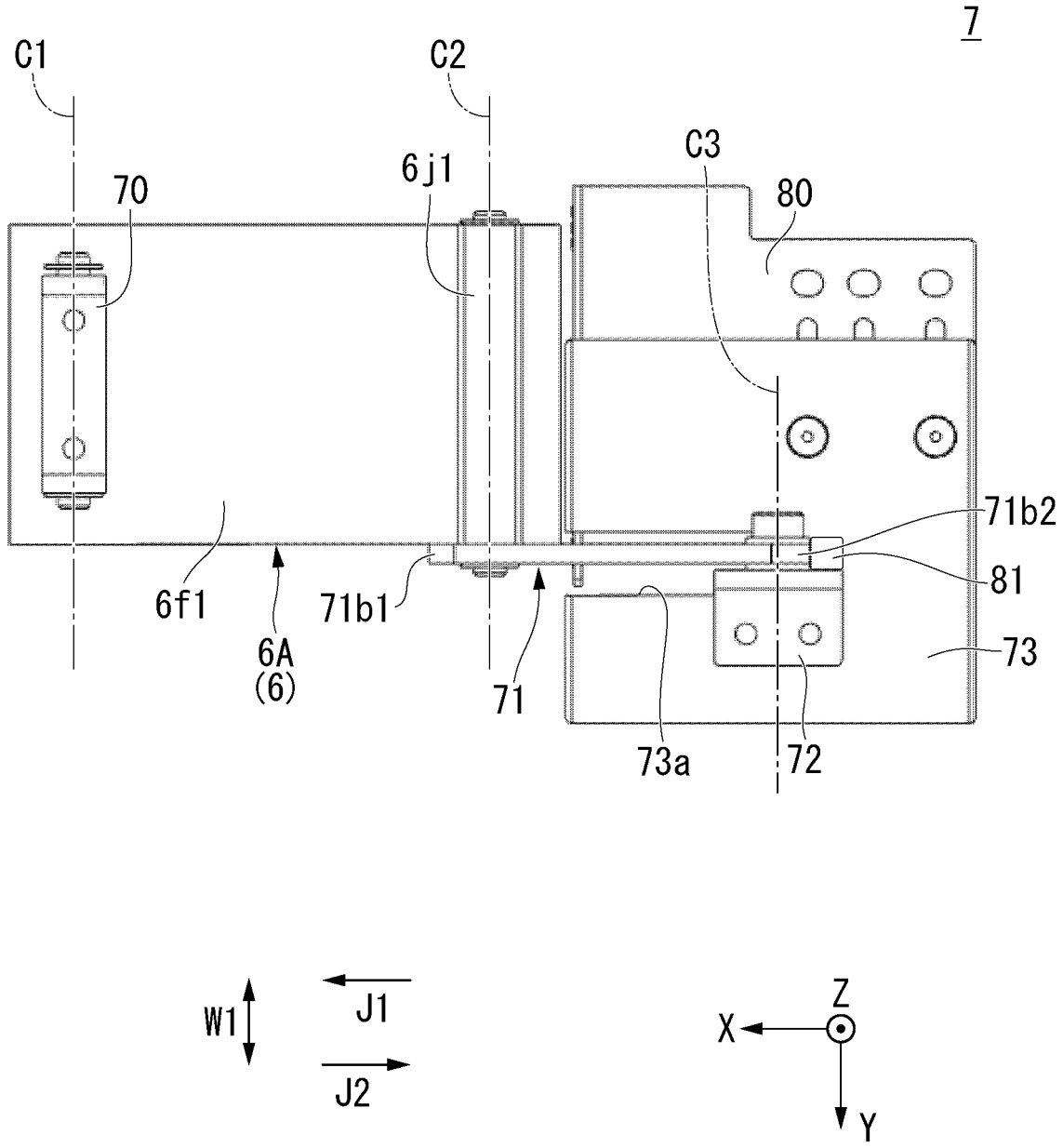
FIG. 12 is a top view showing an upstream portion in the tray pull-out direction of the retreat mechanism of the first embodiment.

As shown in FIG. 12, the abutment member 73 includes a recess 73*a* that is recessed linearly toward an upstream side from a downstream end of the abutment member 73 in the tray pull-out direction J1. In the tray accommodated state, the third corner portion 71*b*3 of the first link member 71 enters the recess 73*a* of the abutment member 73 (see FIG. 11).

As shown in FIG. 10, the third support part 74 is fixed to the top wall 31 (see FIG. 22(A)) of the device body 3. The third support part 74 is disposed downstream of the first support part 70 in the tray pull-out direction J1. The third support part 74 supports the second rectifying member 6B to be rotatable around the fourth axis C4 (the axis substantially parallel to the device width direction W1) in conjunction with the movement of the paper feed tray 2.

In the pull-out operation of the paper feed tray 2, the third support part 74 supports the upstream end portion in the tray pull-out direction J1 of the second rectifying member 6B to be rotatable around the fourth axis C4.

On the other hand, in the push-in operation of the paper feed tray 2, the third support part 74 supports the downstream end portion in the tray push-in direction J2 of the second rectifying member 6B to be rotatable around the fourth axis C4. The third support part 74 has a U shape (inverted U shape) that opens downward to sandwich the third connecting protrusion 6*j*3.

The second link member 75 connects (links) the second rectifying member 6B and the fourth support part 76 in conjunction with the movement of the paper feed tray 2.

As shown in FIG. 9, the second link member 75 includes a second elongated hole 75*a* that supports the downstream end portion in the tray pull-out direction J1 of the second rectifying member 6B and a fifth axis C5 (an axis substantially parallel to the fourth axis C4) to be displaceable in the pull-out operation of the paper feed tray 2.

On the other hand, in the push-in operation of the paper feed tray 2, the second elongated hole 75*a* supports the upstream end portion in the tray push-in direction J2 of the second rectifying member 6B and the fifth axis C5 to be displaceable. Reference 83 in the drawing (see FIG. 6) indicates a second stopper for restricting a rotational position of the second link member 75.

The second link member 75 has a crank shape when viewed from above (see FIG. 6). The second link member 75 has a V shape. The second link member 75 includes a first extending portion 75*b*1, a second extending portion 75*b*2, and a connecting portion 75*b*3 (see FIG. 6).

The first extending portion 75*b*1 includes the second elongated hole 75*a*. The second elongated hole 75*a* extends along the first extending portion 75*b*1. The second elongated hole 75*a* is positioned at an upstream portion in the tray pull-out direction J1 of the first extending portion 75*b*1.

The second extending portion 75*b*2 is directed downward. The second extending portion 75*b*2 is supported to be rotatable around a sixth axis C6.

The connecting portion 75*b*3 extends in the device width direction W1 (see FIG. 6). The connecting portion 75*b*3 connects a downstream end of the first extending portion 75*b*1 to an upper end of the second extending portion 75*b*2 in the tray pull-out direction J1.

The fourth support part 76 is fixed to the top wall 31 (see FIG. 22(A)) of the device body 3. The fourth support part 76 supports the second link member 75 to be rotatable around the sixth axis C6 (the axis substantially parallel to the fourth axis C4) in conjunction with the movement of the paper feed tray 2.

In the pull-out operation of the paper feed tray 2, the fourth support part 76 supports a downstream end portion in the tray pull-out direction J1 of the second link member 75 to be rotatable around the sixth axis C6.

On the other hand, in the push-in operation of the paper feed tray 2, the fourth support part 76 supports an upstream end portion in the tray push-in direction J2 of the second link member to be rotatable around the sixth axis C6. The fourth support part 76 has an L shape having a side surface along one surface of the second link member 75 (second extending portion 75*b*2) (see FIG. 10).

The abutment member 73 comes into contact with the second link member 75 or the second rectifying member 6B in conjunction with the movement of the paper feed tray 2.

At the time of the pull-out operation of the paper feed tray 2, the abutment member 73 comes into contact with the curved lower surface 6*f*2 of the second rectifying member 6B and rotates the second rectifying member 6B around the fourth axis C4 so that the fifth axis C5 is displaced upward. Thereby, the abutment member 73 rotates the second link member 75 around the sixth axis C6.

At the time of the push-in operation of the paper feed tray 2, the abutment member 73 comes into contact with the second extending portion 75*b*2 of the second link member 75 and rotates the second link member 75 around the sixth axis C6 so that the fifth axis C5 is displaced upward. Thereby, the abutment member 73 rotates the second rectifying member 6B around the fourth axis C4 so that the second rectifying member 6B retreats from the paper feed tray 2.

An example of the pull-out operation of the paper feed tray 2 will be described. The pull-out operation of the paper feed tray 2 is an operation of pulling (an operation of taking) the paper feed tray 2 out of the accommodating part 30 of the device body 3.

Figure 13:
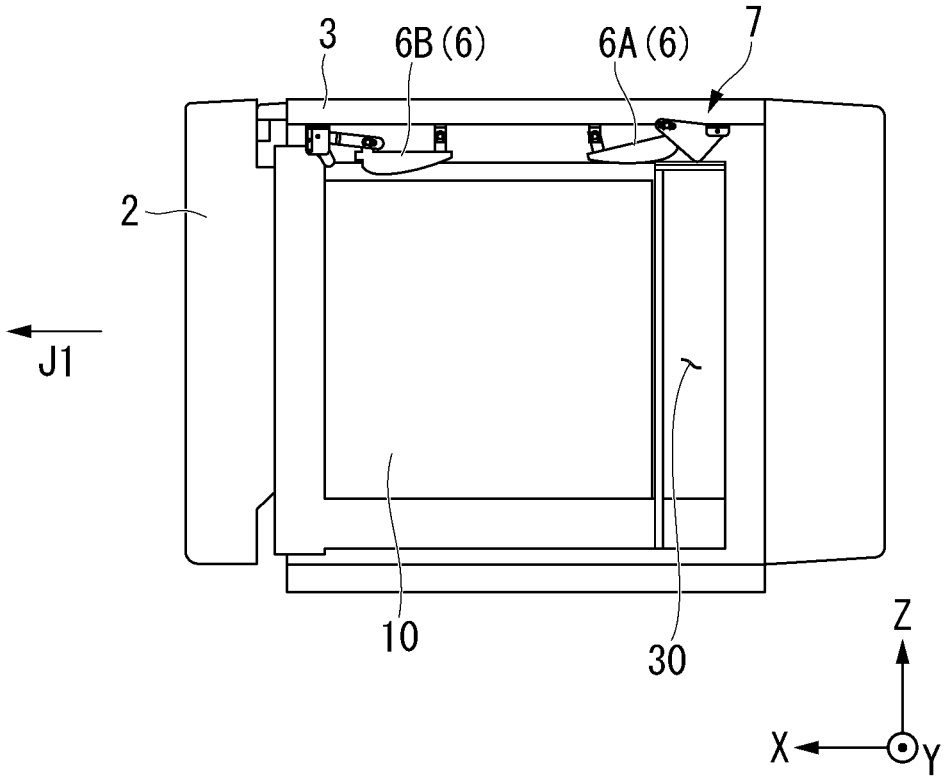
FIG. 13 is a side view showing a pull-out operation of the paper feed tray of the first embodiment.
Figure 14:
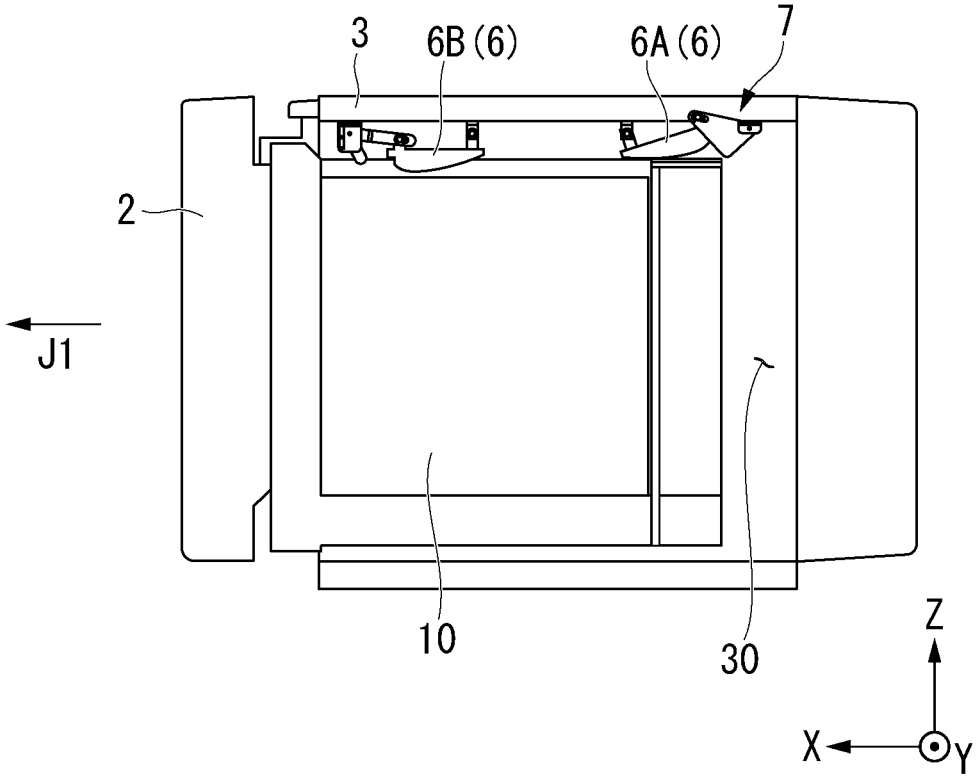
FIG. 14 continues from FIG. 13 and is a side view showing the pull-out operation of the paper feed tray.
Figure 15:
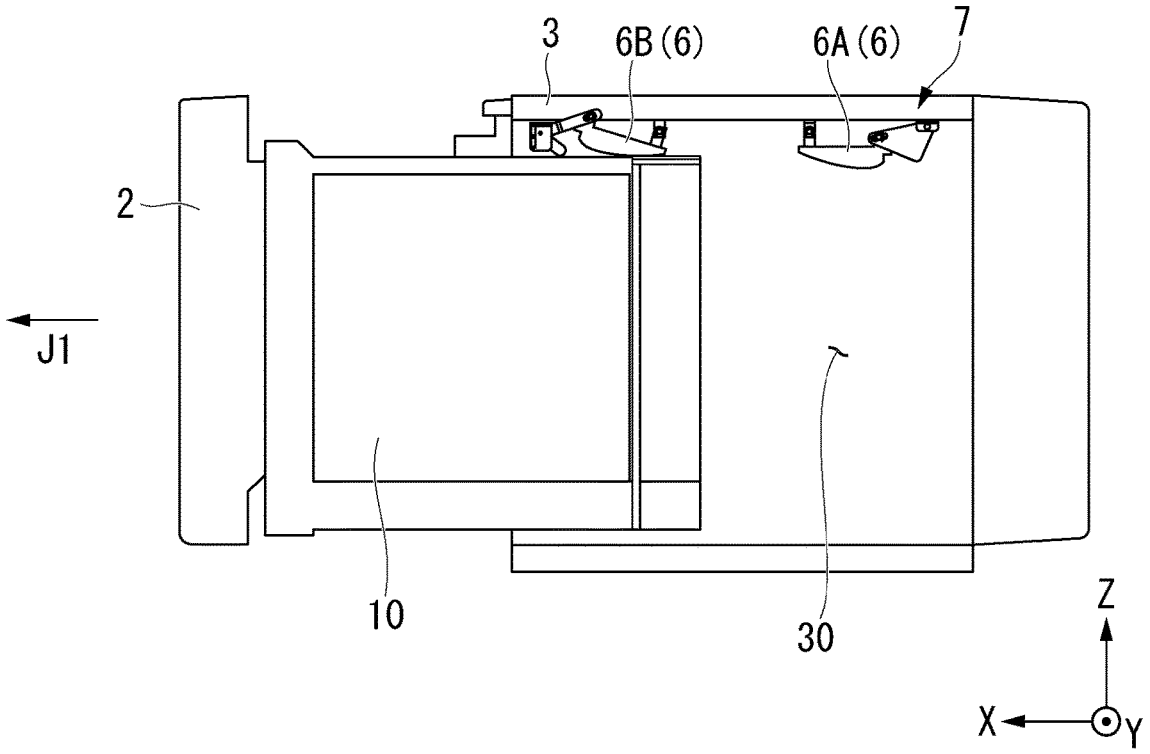
FIG. 15 continues from FIG. 14 and is a side view showing the pull-out operation of the paper feed tray.
Figure 16:
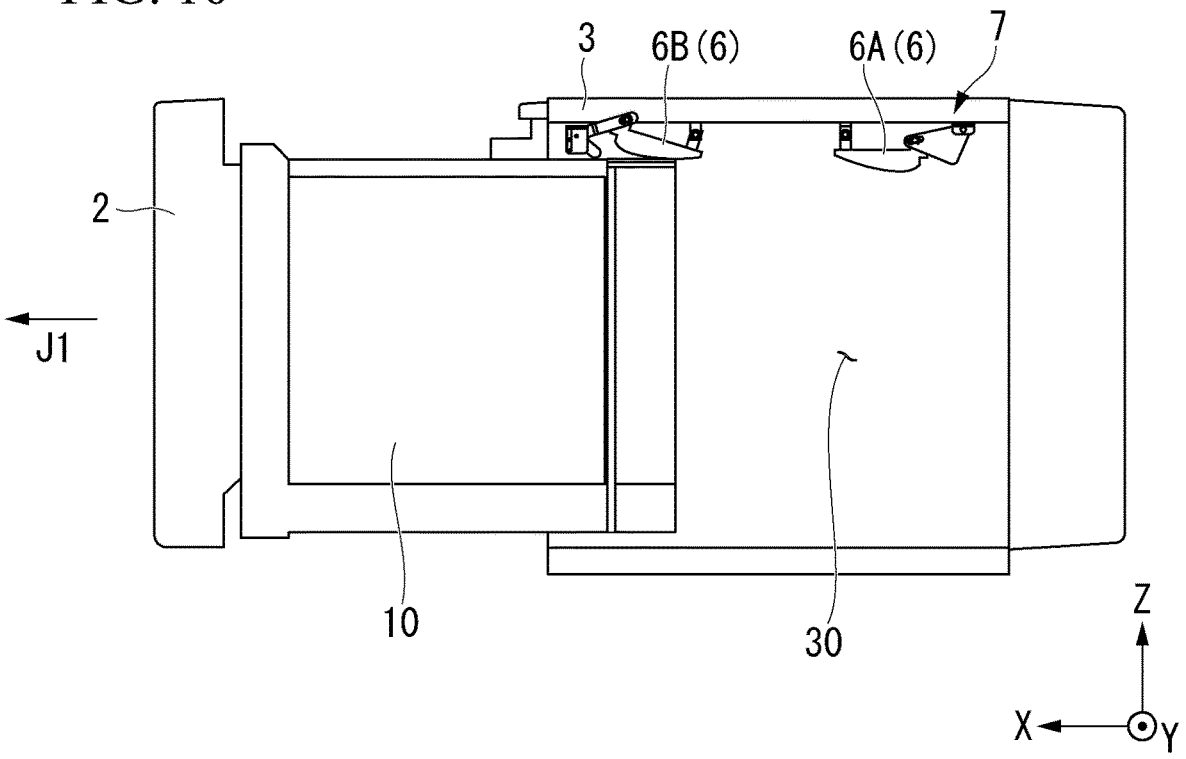
FIG. 16 continues from FIG. 15 and is a side view showing the pull-out operation of the paper feed tray.

FIG. 13 is a side view showing the pull-out operation of the paper feed tray 2 of the first embodiment. FIGS. 14 to 16 continue in sequence from FIG. 13 and are side views showing the pull-out operation of the paper feed tray 2.

The pull-out operation of the paper feed tray 2 acts in the arrow J1 direction (in a direction opposite to the push-in direction) in the drawing. For example, it can be brought into the tray taken-out state by gradually moving the paper feed tray 2 in the arrow J1 direction from the tray accommodated state (see FIGS. 13 to 16). At the time of the pull-out operation of the paper feed tray 2, the retreat mechanism 7 displaces each of the first rectifying member 6A and the second rectifying member 6B in conjunction with the movement of the paper feed tray 2 so that each of the first rectifying member 6A and the second rectifying member 6B retreats from the paper feed tray 2.

An example of the push-in operation of the paper feed tray 2 will be described. The push-in operation of the paper feed tray 2 is an operation of pushing the paper feed tray 2 into the accommodating part 30 of the device body 3.

Figure 17:
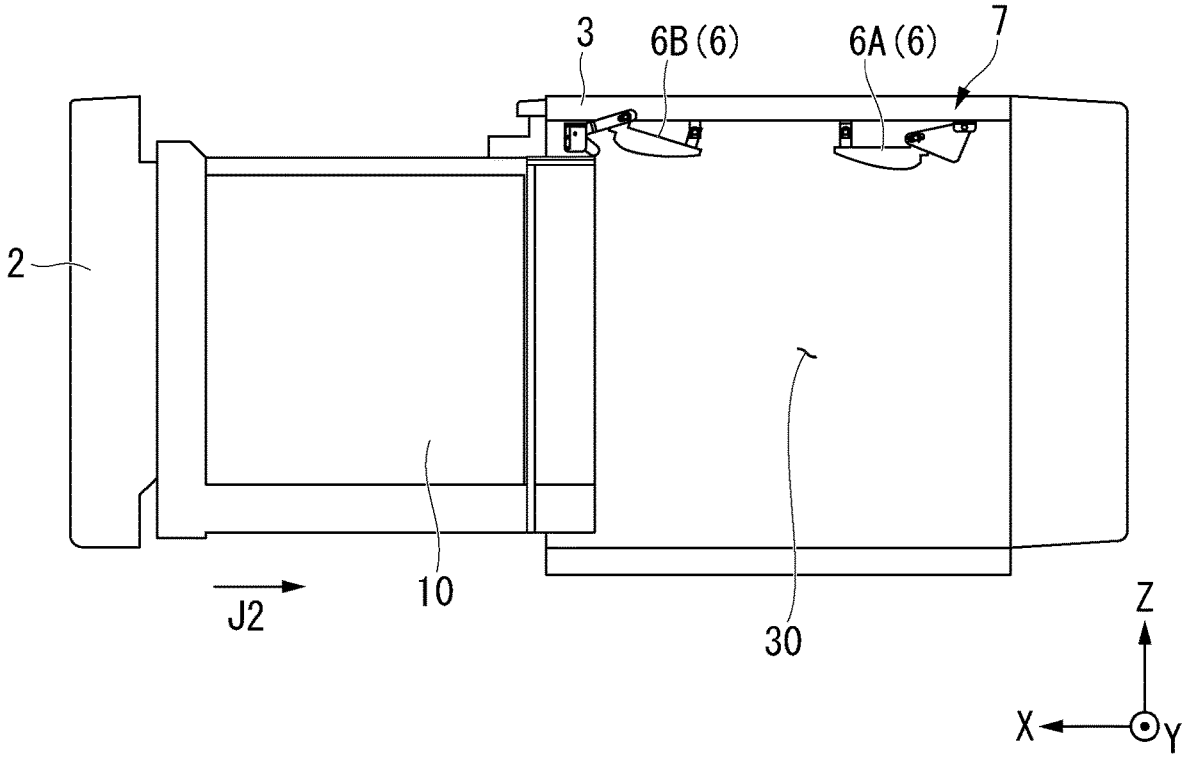
FIG. 17 is a side view showing a push-in operation of the paper feed tray of the first embodiment.
Figure 18:
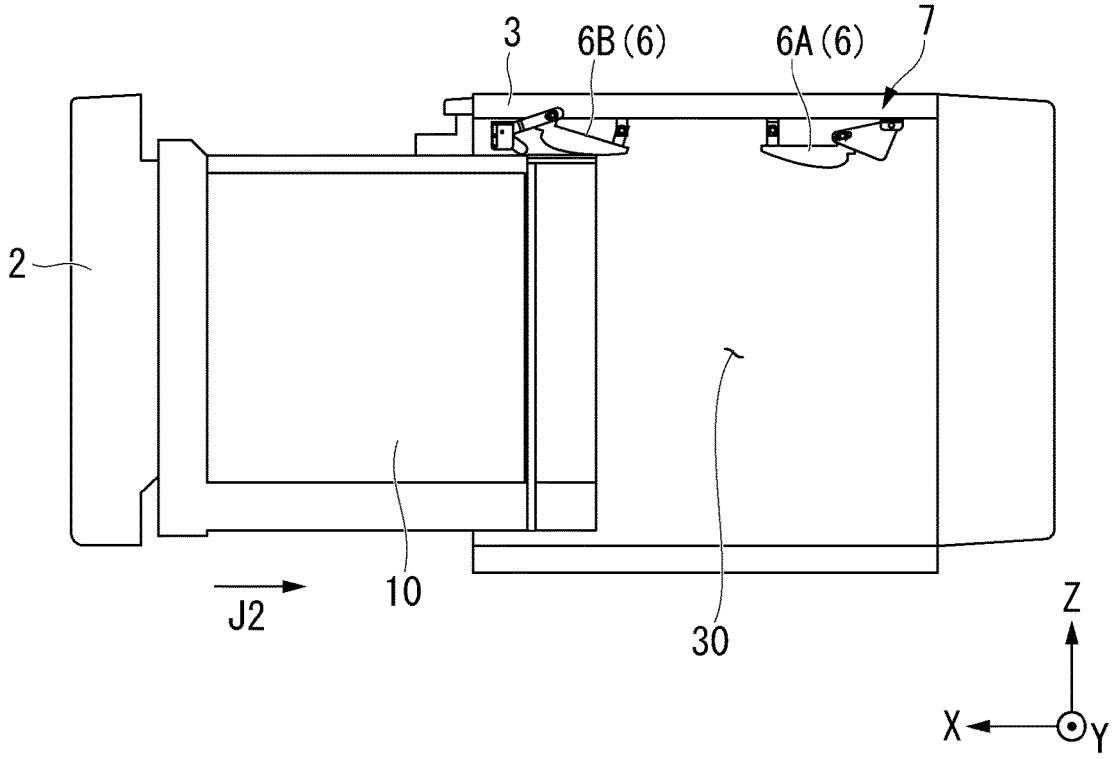
FIG. 18 continues from FIG. 17 and is a side view showing the push-in operation of the paper feed tray.
Figure 19:
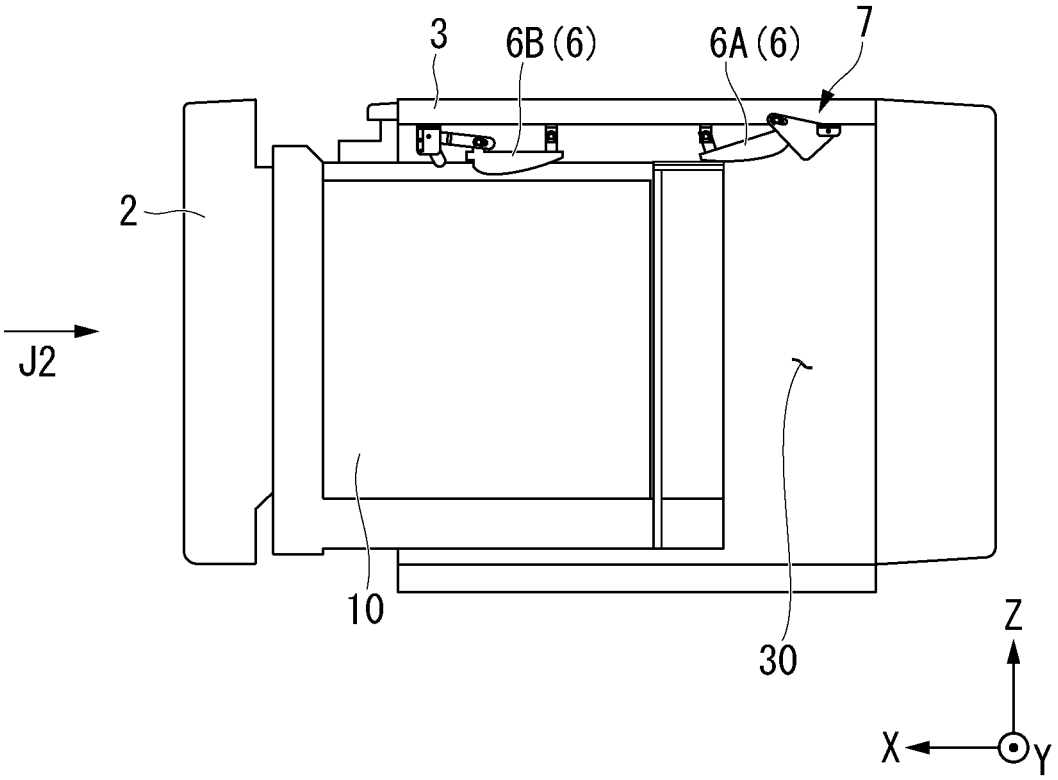
FIG. 19 continues from FIG. 18 and is a side view showing the push-in operation of the paper feed tray.
Figure 20:
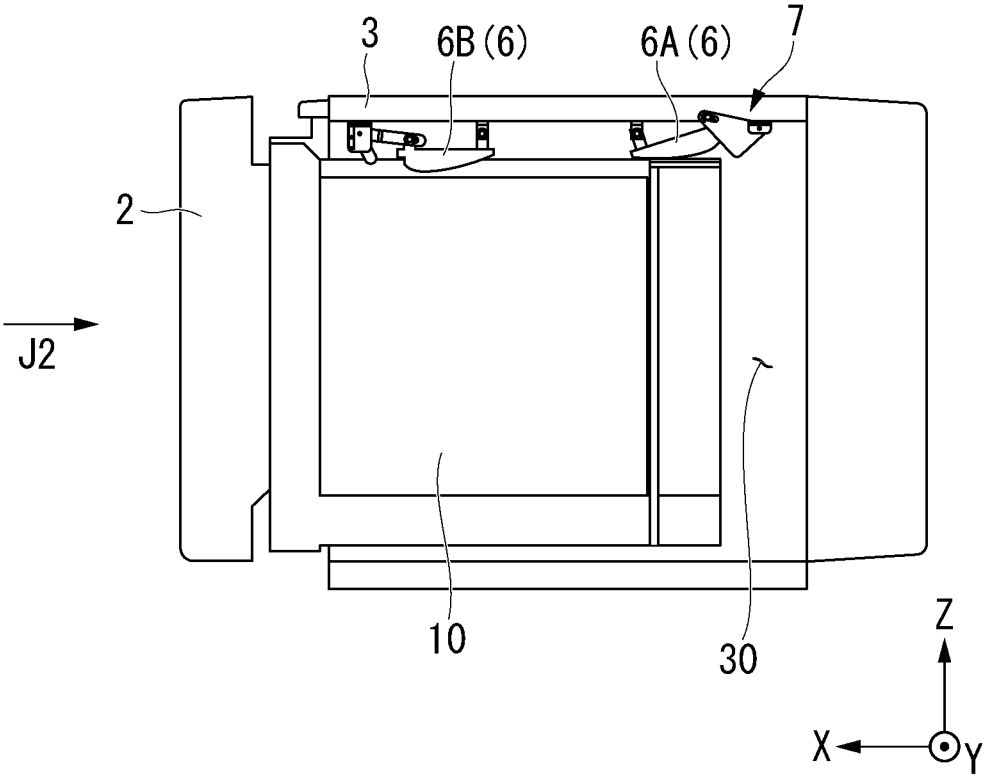
FIG. 20 continues from FIG. 19 and is a side view showing the push-in operation of the paper feed tray.

FIG. 17 is a side view showing the push-in operation of the paper feed tray 2 of the first embodiment. FIGS. 18 to 20 continue in sequence from FIG. 17 and are side views showing the push-in operation of the paper feed tray 2.

The push-in operation of the paper feed tray 2 acts in the arrow J2 direction (in a direction opposite to the pull-out direction) in the drawing. For example, it can be brought into the tray accommodated state by gradually moving the paper feed tray 2 in the arrow J2 direction from the tray taken-out state (see FIGS. 17 to 20). At the time of the push-in operation of the paper feed tray 2, the retreat mechanism 7 displaces each of the first rectifying member 6A and the second rectifying member 6B in conjunction with the movement of the paper feed tray 2 so that each of the first rectifying member 6A and the second rectifying member 6B retreats from the paper feed tray 2.

An example of an operation of the retreat mechanism 7 at the time of the pull-out operation of the paper feed tray 2 will be described.

Figure 21:
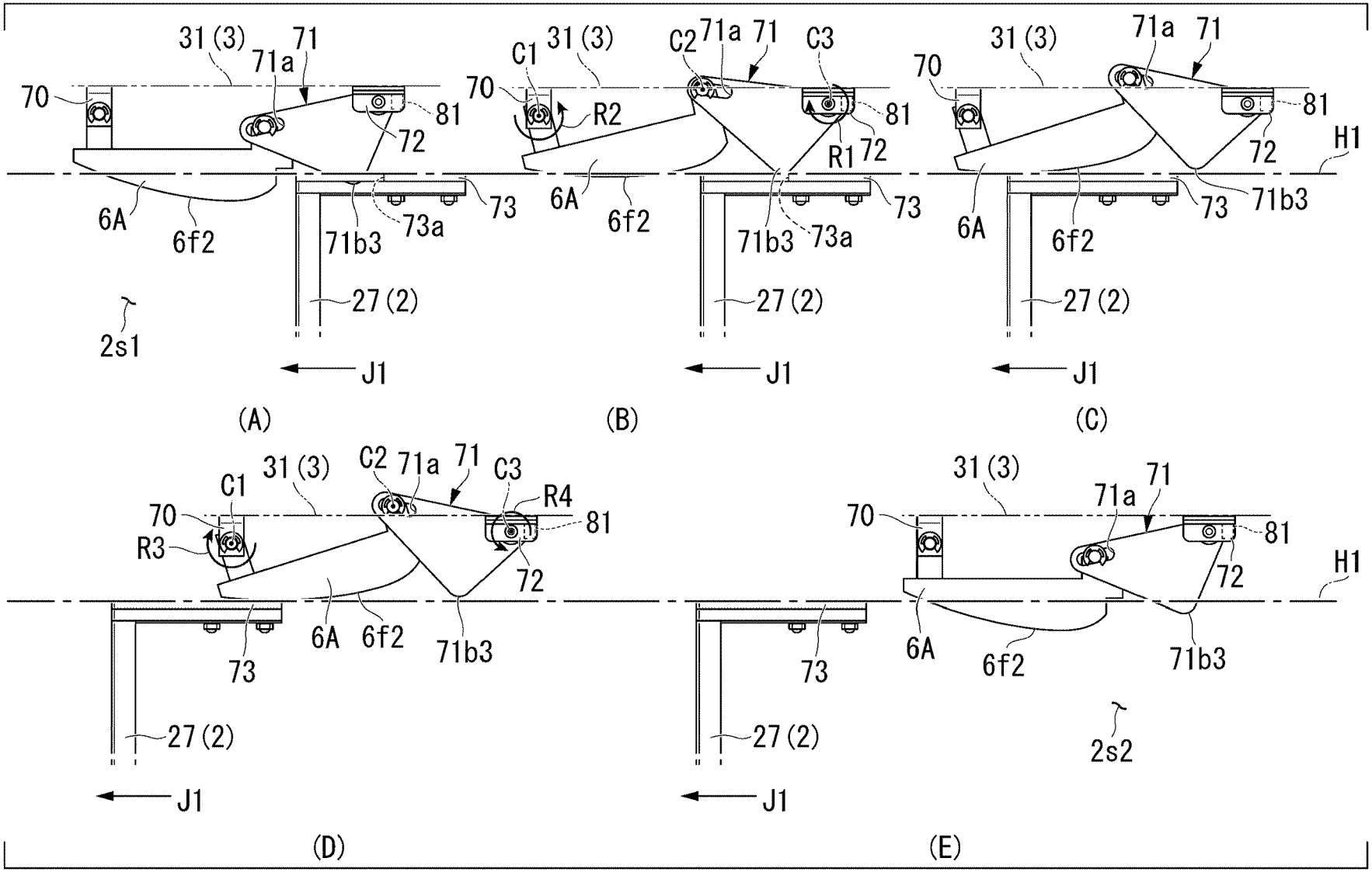
FIG. 21 is an operation explanatory view of the upstream portion in the tray pull-out direction of the retreat mechanism at the time of the pull-out operation of the paper feed tray of the first embodiment.

FIG. 21 is an operation explanatory view of an upstream portion in the tray pull-out direction J1 of the retreat mechanism 7 at the time of the pull-out operation of the paper feed tray 2 of the first embodiment. FIG. 21(A) is a side view showing an initial position of the paper feed tray 2. FIGS. 21(B) to 21(E) continue in sequence from FIG. 21(A) and are side views showing states in which the paper feed tray 2 is moved to a position downstream of the initial position in the tray pull-out direction J1.

Figure 22:
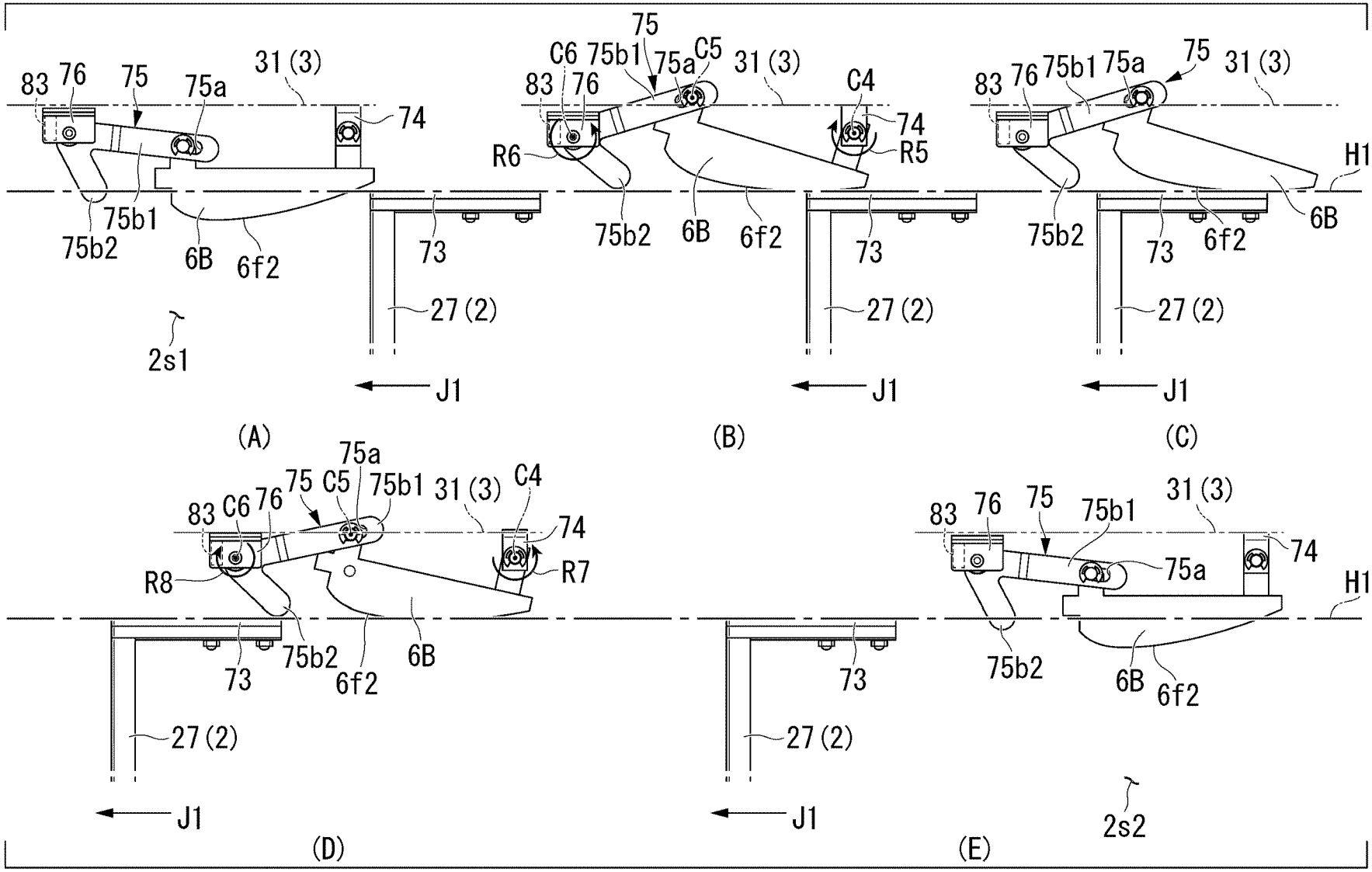
FIG. 22 is an operation explanatory view of the downstream portion in the tray pull-out direction of the retreat mechanism at the time of the pull-out operation of the paper feed tray of the first embodiment.

FIG. 22 is an operation explanatory view of a downstream portion in the tray pull-out direction J1 of the retreat mechanism 7 at the time of the pull-out operation of the paper feed tray 2 of the first embodiment. FIGS. 22(A) to 22(E) continue in sequence from FIG. 21(E) and are side views showing states in which the paper feed tray 2 is moved to a position downstream of the position in FIG. 21(E) in the tray pull-out direction J1. Reference H1 in the drawing indicates a virtual horizontal line passing through an upper surface of the abutment member 73.

The initial position of the paper feed tray 2 means a position of the paper feed tray 2 in the tray accommodated state. That is, the initial position of the paper feed tray 2 is a position before the paper feed tray 2 is pulled out of the accommodating part 30 (see FIG. 13). As shown in FIG. 21(A), when the paper feed tray 2 is at the initial position, the third corner portion 71*b*3 of the first link member 71 has entered the recess 73*a* of the abutment member 73. When the paper feed tray 2 is at the initial position, the curved lower surface 6*f*2 of the first rectifying member 6A is positioned below the virtual horizontal line H1. In the state of FIG. 21(A), the first link member 71 is positioned at its regular position by a weight of the first rectifying member 6A acting thereon and by being in contact with the first stopper 81.

As shown in FIG. 21(B), when the paper feed tray 2 is moved in the arrow J1 direction from the initial position of the paper feed tray 2, a bottom end of the recess 73*a* (upstream end in the tray pull-out direction) of the abutment member 73 comes into contact with the third corner portion 71*b*3 of the first link member 71. Then, the first link member 71 rotates around the third axis C3 in an arrow R1 direction (clockwise in the drawing) so that the second axis C2 is displaced upward. At this time, the second axis C2 moves along the first elongated hole 71*a*. Thereby, the first rectifying member 6A rotates around the first axis C1 in an arrow R2 direction (counterclockwise in the drawing) to retreat from the paper feed tray 2. That is, the first rectifying member 6A is displaced upward to retreat from the paper feed tray 2. At this time, the curved lower surface 6*f*2 of the first rectifying member 6A overlaps the virtual horizontal line H1.

As shown in FIG. 21(C), when the paper feed tray 2 is moved in the arrow J1 direction from the position thereof in FIG. 21(B), the abutment member 73 moves while avoiding the first rectifying member 6A while touching the curved lower surface 6*f*2 of the first rectifying member 6A. In the state of FIG. 21(C), the downstream end in the tray pull-out direction J1 of the abutment member 73 touches the curved lower surface 6*f*2 of the first rectifying member 6A. At this time, the first rectifying member 6A is displaced to its uppermost position. Since the curved lower surface 6*f*2 of the first rectifying member 6A has a curved shape that is convex downward, the first rectifying member 6A can be smoothly displaced upward in conjunction with the movement of the abutment member 73 in the arrow J1 direction.

As shown in FIG. 21(D), when the paper feed tray 2 is moved in the arrow J1 direction from the position thereof in FIG. 21(C), the first rectifying member 6A loses its support from the abutment member 73. Then, the first rectifying member 6A rotates around the first axis C1 in an arrow R3 direction (clockwise in the drawing) so that the second axis C2 is displaced downward. That is, the first rectifying member 6A is displaced downward by the weight thereof. At this time, the first link member 71 rotates around the third axis C3 in an arrow R4 direction (counterclockwise in the drawing) in conjunction with the movement of the first rectifying member 6A. That is, the first link member 71 is displaced downward by the weight of the first rectifying member 6A.

As shown in FIG. 21(E), when the paper feed tray 2 is moved in the arrow J1 direction from the position thereof in FIG. 21(D), the first rectifying member 6A is displaced to the external space 2*s*2 of the paper feed tray 2. At this time, the curved lower surface 6*f*2 of the first rectifying member 6A is positioned below the virtual horizontal line H1. That is, the first rectifying member 6A is in the same state as when the paper feed tray 2 is at the initial position.

As shown in FIG. 22(A), when the paper feed tray 2 is moved in the arrow J1 direction from the position thereof in FIG. 21(E), the abutment member 73 moves toward the second rectifying member 6B. Before the abutment member 73 comes into contact with the second rectifying member 6B, the curved lower surface 6*f*2 of the second rectifying member 6B is positioned below the virtual horizontal line H1. In the state of FIG. 22(A), the second link member 75 is positioned at its regular position by a weight of the second rectifying member 6B acting thereon and by being in contact with the second stopper 83.

As shown in FIG. 22(B), when the paper feed tray 2 is moved in the arrow J1 direction from the position thereof in FIG. 22(A), the abutment member 73 comes into contact with the curved lower surface 6*f*2 of the second rectifying member 6B. Then, the second rectifying member 6B rotates around the fourth axis C4 in an arrow R5 direction (clockwise in the drawing) so that the fifth axis C5 is displaced upward. At this time, the fifth axis C5 moves along the second elongated hole 75*a*. Thereby, the second rectifying member 6B is displaced upward to retreat from the paper feed tray 2. At this time, the second link member 75 rotates around the sixth axis C6 in an arrow R6 direction (counterclockwise in the drawing) in conjunction with the movement of the second rectifying member 6B. In the state of FIG. 22(B), the curved lower surface 6*f*2 of the second rectifying member 6B overlaps the virtual horizontal line H1.

As shown in FIG. 22(C), when the paper feed tray 2 is moved in the arrow J1 direction from the position thereof in FIG. 22(B), the abutment member 73 moves while avoiding the second rectifying member 6B while touching the curved lower surface 6*f*2 of the second rectifying member 6B. In the state of FIG. 22(C), an upstream end in the tray pull-out direction J1 of the abutment member 73 touches the curved lower surface 6*f*2 of the second rectifying member 6B. At this time, the second rectifying member 6B is displaced to its uppermost position. Since the curved lower surface 6*f*2 of the second rectifying member 6B has a curved shape that is convex downward, the second rectifying member 6B can be smoothly displaced upward in conjunction with the movement of the abutment member 73 in the arrow J1 direction.

As shown in FIG. 22(D), when the paper feed tray 2 is moved in the arrow J1 direction from the position thereof in FIG. 22(C), the second rectifying member 6B loses its support from the abutment member 73. Then, the second rectifying member 6B rotates around the fourth axis C4 in an arrow R7 direction (counterclockwise in the drawing) so that the fifth axis C5 is displaced downward. That is, the second rectifying member 6B is displaced downward by the weight thereof. At this time, the second link member 75 rotates around the sixth axis C6 in an arrow R8 direction (clockwise in the drawing) in conjunction with the movement of the second rectifying member 6B. That is, the second link member 75 is displaced downward by the weight of the second rectifying member 6B.

As shown in FIG. 22(E), when the paper feed tray 2 is moved in the arrow J1 direction from the position thereof in FIG. 22(D), the second rectifying member 6B is displaced to the external space 2*s*2 of the paper feed tray 2. At this time, the curved lower surface 6f2 of the second rectifying member 6B is positioned below the virtual horizontal line H1. That is, the second rectifying member 6B is in the same state as that before the abutment member 73 is in contact with the second rectifying member 6B. In the state of FIG. 22(E), a lower end portion of the second extending portion 75*b*2 of the second link member 75 is positioned below the virtual horizontal line H1.

An example of an operation of the retreat mechanism 7 at the time of the push-in operation of the paper feed tray 2 will be described.

Figure 23:
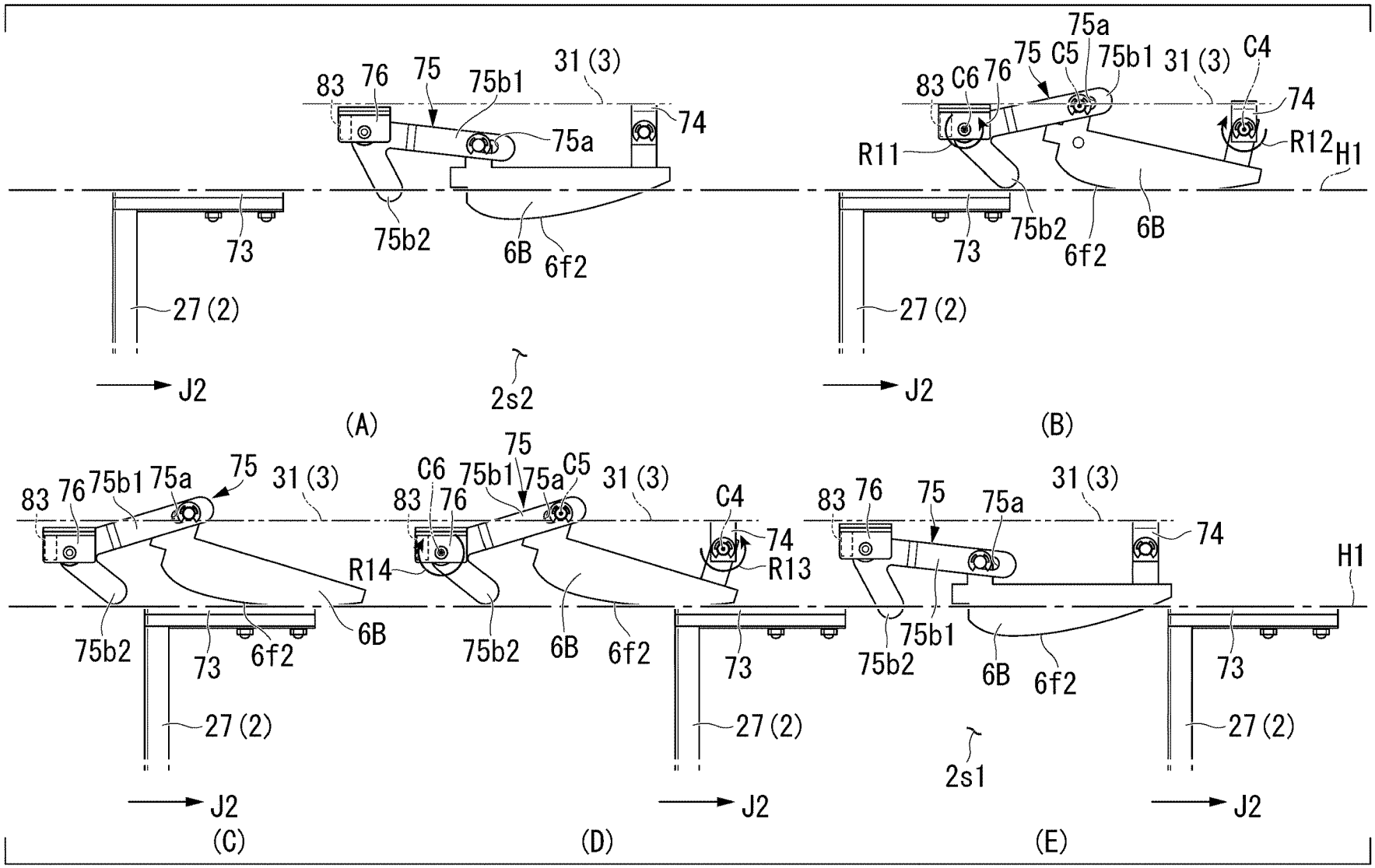
FIG. 23 is an operation explanatory view of an upstream portion in a tray push-in direction of the retreat mechanism at the time of the push-in operation of the paper feed tray of the first embodiment.

FIG. 23 is an operation explanatory view of an upstream portion in the tray push-in direction J2 of the retreat mechanism 7 at the time of the push-in operation of the paper feed tray 2 of the first embodiment. FIG. 23(A) is a side view showing a taken-out position of the paper feed tray 2. FIGS. 23(B) to 23(E) continue in sequence from FIG. 23(A) and are side views showing states in which the paper feed tray 2 is moved to a position downstream of the position in FIG. 23(A) in the tray push-in direction J2.

Figure 24:
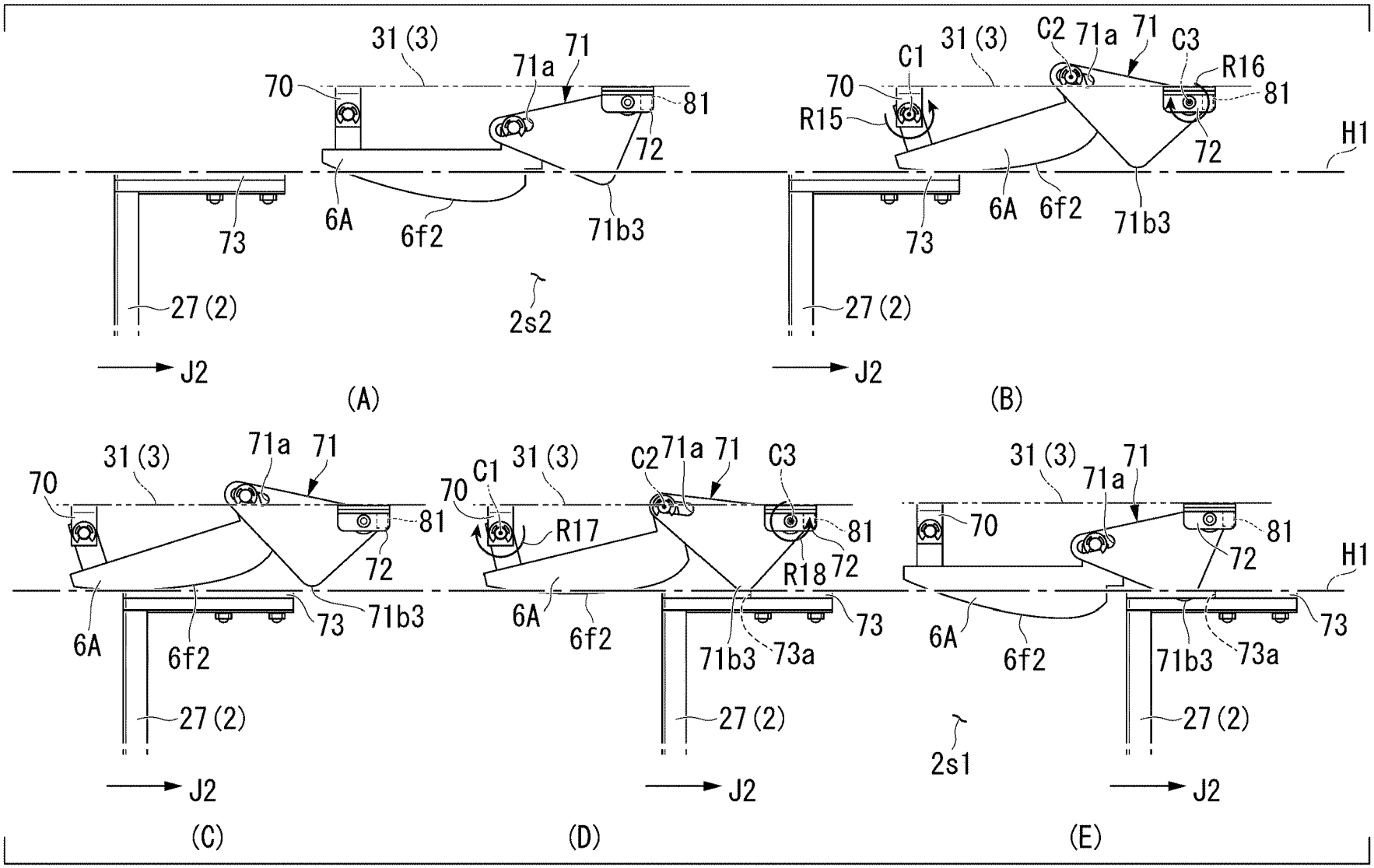
FIG. 24 is an operation explanatory view of a downstream portion in the tray push-in direction of the retreat mechanism at the time of the push-in operation of the paper feed tray of the first embodiment.

FIG. 24 is an operation explanatory view of a downstream portion in the tray push-in direction J2 of the retreat mechanism 7 at the time of the push-in operation of the paper feed tray 2 of the first embodiment. FIGS. 24A to 24E continue in sequence from FIG. 23E and are side views showing states in which the paper feed tray 2 is moved to a position downstream of the position thereof in FIG. 23(E) in the tray push-in direction J2.

The taken-out position of the paper feed tray 2 means a position of the paper feed tray 2 in the tray taken-out state. That is, the taken-out position of the paper feed tray 2 is a position after the paper feed tray 2 has been pulled out of the accommodating part 30 (see FIG. 17). As shown in FIG. 23(A), the lower end portion of the second extending portion 75*b*2 of the second link member 75 is positioned below the virtual horizontal line H1 at the taken-out position of the paper feed tray 2. When the paper feed tray 2 is at the taken-out position, the curved lower surface 6f2 of the second rectifying member 6B is positioned below the virtual horizontal line H1. In the state of FIG. 23(A), the second link member 75 is positioned at its regular position by the weight of the second rectifying member 6B acting thereon and by being in contact with the second stopper 83.

As shown in FIG. 23(B), when the paper feed tray 2 is moved in the arrow J2 direction from the taken-out position of the paper feed tray 2, the abutment member 73 comes into contact with the lower end portion of the second extending portion 75*b*2 of the second link member 75. Then, the second link member 75 rotates around the sixth axis C6 in an arrow R11 direction (counterclockwise in the drawing) so that the fifth axis C5 is displaced upward. At this time, the fifth axis C5 moves along the second elongated hole 75*a*. Thereby, the second rectifying member 6B rotates around the third axis C3 in an arrow R12 direction (clockwise in the drawing) to retreat from the paper feed tray 2. That is, the second rectifying member 6B is displaced upward to retreat from the paper feed tray 2. At this time, the curved lower surface 6f2 of the second rectifying member 6B overlaps the virtual horizontal line H1.

As shown in FIG. 23(C), when the paper feed tray 2 is moved in the arrow J2 direction from the position thereof in FIG. 23(B), the abutment member 73 moves while avoiding the second rectifying member 6B while touching the curved lower surface 6f2 of the second rectifying member 6B. In the state of FIG. 23(C), the downstream end in the tray push-in direction J2 of the abutment member 73 touches the curved lower surface 6f2 of the second rectifying member 6B. At this time, the second rectifying member 6B is displaced to its uppermost position. Since the curved lower surface 6f2 of the second rectifying member 6B has a curved shape that is convex downward, the second rectifying member 6B can be smoothly displaced upward in conjunction with the movement of the abutment member 73 in the arrow J2 direction.

As shown in FIG. 23(D), when the paper feed tray 2 is moved in the arrow J2 direction from the position thereof in FIG. 23(C), the second rectifying member 6B loses its support from the abutment member 73. Then, the second rectifying member 6B rotates around the fourth axis C4 in an arrow R13 direction (counterclockwise in the drawing) so that the fifth axis C5 is displaced downward. That is, the second rectifying member 6B is displaced downward by the weight thereof. At this time, the second link member 75 rotates around the sixth axis C6 in an arrow R14 direction (clockwise in the drawing) in conjunction with the movement of the second rectifying member 6B. That is, the second link member 75 is displaced downward by the weight of the second rectifying member 6B.

As shown in FIG. 23(E), when the paper feed tray 2 is moved in the arrow J2 direction from the position thereof in FIG. 23(D), the second rectifying member 6B is displaced to the internal space 2*s*1 of the paper feed tray 2. At this time, the curved lower surface 6f2 of the second rectifying member 6B is positioned below the virtual horizontal line H1. That is, the second rectifying member 6B is in the same state as that when the paper feed tray 2 is at the taken-out position.

As shown in FIG. 24(A), when the paper feed tray 2 is moved in the arrow J2 direction from the position thereof in FIG. 23(E), the abutment member 73 moves toward the first rectifying member 6A. Before the abutment member 73 comes into contact with the first rectifying member 6A, the curved lower surface 6f2 of the first rectifying member 6A is positioned below the virtual horizontal line H1. In the state of FIG. 24(A), the first link member 71 is positioned at its regular position by the weight of the first rectifying member 6A acting thereon and by being in contact with the first stopper 81.

As shown in FIG. 24(B), when the paper feed tray 2 is moved in the arrow J2 direction from the position thereof in FIG. 24(A), the abutment member 73 comes into contact with the curved lower surface 6f2 of the first rectifying member 6A. Then, the first rectifying member 6A rotates around the first axis C1 in an arrow R15 direction (counterclockwise in the drawing) so that the second axis C2 is displaced upward. At this time, the second axis C2 moves along the first elongated hole 71*a*. That is, the first rectifying member 6A is displaced upward to retreat from the paper feed tray 2. At this time, the first link member 71 rotates around the third axis C3 in an arrow R16 direction (clockwise in the drawing) in conjunction with the movement of the first rectifying member 6A. In the state of FIG. 24(B), the curved lower surface 6f2 of the first rectifying member 6A overlaps the virtual horizontal line H1.

As shown in FIG. 24(C), when the paper feed tray 2 is moved in the arrow J2 direction from the position thereof in FIG. 24(B), the abutment member 73 moves while avoiding the first rectifying member 6A while touching the curved lower surface 6f2 of the first rectifying member 6A. In the state of FIG. 24(C), the upstream end of the abutment member 73 in the tray push-in direction J2 touches the curved lower surface 6f2 of the first rectifying member 6A. At this time, the first rectifying member 6A is displaced to its uppermost position. Since the curved lower surface 6f2 of the first rectifying member 6A has a curved shape that is convex downward, the first rectifying member 6A can be smoothly displaced upward in conjunction with the movement of the abutment member 73 in the arrow J2 direction.

As shown in FIG. 24(D), when the paper feed tray 2 is moved in the arrow J2 direction from the position thereof in FIG. 24(C), the first rectifying member 6A loses its support from the abutment member 73. Then, the first rectifying member 6A rotates around the first axis C1 in an arrow R17 direction (clockwise in the drawing) so that the second axis C2 is displaced downward. That is, the first rectifying member 6A is displaced downward by the weight thereof. At this time, the first link member 71 rotates around the third axis C3 in an arrow R18 direction (counterclockwise in the drawing) in conjunction with the movement of the first rectifying member 6A. That is, the first link member 71 is displaced downward by the weight of the first rectifying member 6A.

As shown in FIG. 24(E), when the paper feed tray 2 is moved in the arrow J2 direction from the position thereof in FIG. 24(D), the first rectifying member 6A is displaced to the internal space 2*s*1 of the paper feed tray 2. At this time, the curved lower surface 6*f*2 of the first rectifying member 6A is positioned below the virtual horizontal line H1. That is, the first rectifying member 6A is in the same state as when the paper feed tray 2 is at the initial position. In the state of FIG. 24(E), the third corner portion 71*b*3 of the first link member 71 has entered the recess 73*a* of the abutment member 73.

According to the first embodiment, the paper feeding device 1 includes the paper feed tray 2, the device body 3, the fan 4, the rectifying member 6, and the retreat mechanism 7. The paper bundle 10 in which a plurality of sheets of paper are stacked can be placed on the paper feed tray 2. The device body 3 includes the accommodating part 30 capable of accommodating the paper feed tray 2. The fan 4 can generate airflow. The rectifying member 6 is positioned above the paper bundle 10 placed on the paper feed tray 2 in a state in which the paper feed tray 2 is accommodated in the accommodating part 30. In a state in which the paper feed tray 2 is accommodated in the accommodating part 30, the rectifying member 6 generates a negative pressure between the rectifying member 6 and the uppermost sheet of paper 11 of the paper bundle 10 using the airflow from the fan 4. In both the pull-out operation and the push-in operation of the paper feed tray 2, the retreat mechanism 7 displaces the rectifying member 6 in conjunction with the movement of the paper feed tray 2 so that the rectifying member 6 retreats from the paper feed tray 2. With the configuration above, the following effects are achieved.

When the rectifying member 6 is assumed to be fixed at the regular position above the paper bundle 10, the rectifying member 6 may become obstacle when the paper feed tray 2 is taken out for refilling paper or the like. On the other hand, according to the embodiment, the rectifying member 6 can be displaced in conjunction with the movement of the paper feed tray 2 by the action of the retreat mechanism 7 and the rectifying member 6 can be retreated from the paper feed tray 2. Therefore, when the paper feed tray 2 is moved, the rectifying member 6 can be inhibited from becoming an obstacle.

The retreat mechanism 7 displaces the rectifying member 6 to the internal space 2*s*1 of the paper feed tray 2 in a state in which the paper feed tray 2 is accommodated in the accommodating part 30. The retreat mechanism 7 displaces the rectifying member 6 to the external space 2*s*2 of the paper feed tray 2 in a state in which the paper feed tray 2 is taken out of the accommodating part 30. With the configuration above, the following effects are achieved.

In the tray accommodated state, the rectifying member 6 can be disposed at the regular position above the paper bundle 10. Therefore, action of the rectifying member 6 can be effectively exhibited.

On the other hand, in the tray taken-out state, the rectifying member 6 is not present above the paper feed tray 2, and the paper feed tray 2 opens upward. Therefore, when the paper feed tray 2 is refilled with the paper bundle 10, the rectifying member 6 can be inhibited from becoming obstacle.

The retreat mechanism 7 includes the first support part 70 fixed to the device body 3 and configured to support the downstream end portion in the tray pull-out direction J1 of the rectifying member 6 to be rotatable around the first axis C1, the first link member 71 having the first elongated hole 71*a* which supports the upstream end portion in the tray pull-out direction J1 of the rectifying member 6 and the second axis C2 to be displaceable, the second support part 72 fixed to the device body 3 and configured to support the upstream end portion in the tray pull-out direction J1 of the first link member 71 to be rotatable around the third axis C3, and the abutment member 73 fixed to the paper feed tray 2 and configured to come into contact with the first link member 71 and rotate the first link member 71 around the third axis C3 to displace the second axis C2 upward so that the rectifying member 6 is rotated around the first axis C1 to cause the rectifying member 6 to retreat from the paper feed tray 2 at the time of the pull-out operation of the paper feed tray 2. With the configuration above, the following effects are achieved.

With a simple structure in which the first support part 70, the first link member 71, and the second support part 72 are provided on the device body 3 side while the abutment member 73 is provided on the paper feed tray 2 side, an interlocking operation at the time of the tray pull-out operation can be realized.

The retreat mechanism 7 includes the first support part 70 fixed to the device body 3 and configured to support the upstream end portion in the tray push-in direction J2 of the rectifying member 6 to be rotatable around the first axis C1, the first link member 71 having the first elongated hole 71*a* which supports the downstream end portion in the tray push-in direction J2 of the rectifying member 6 and the second axis C2 to be displaceable, the second support part 72 fixed to the device body 3 and configured to support the downstream end portion in the tray push-in direction J2 of the first link member 71 to be rotatable around the third axis C3, and the abutment member 73 fixed to the paper feed tray 2 and configured to come into contact with the rectifying member 6 and rotate the rectifying member 6 around the first axis C1 to displace the second axis C2 upward so that the first link member 71 is rotated around the third axis C3 at the time of the push-in operation of the paper feed tray 2. With the configuration above, the following effects are achieved.

With a simple structure in which the first support part 70, the first link member 71, and the second support part 72 are provided on the device body 3 side while the abutment member 73 is provided on the paper feed tray 2 side, an interlocking operation at the time of the tray push-in operation can be realized.

The first link member 71 has a triangular shape which is convex downward. The first link member 71 includes the first corner portion 71*b*1 having the first elongated hole 71*a*, the second corner portion 71*b*2 supported to be rotatable around the third axis C3, and the third corner portion 71*b*3 which is convex downward. The abutment member 73 comes into contact with the third corner portion 71*b*3 of the first link member 71 at the time of the pull-out operation of the paper feed tray 2. With the configuration above, the following effects are achieved.

An interlocking operation at the time of the tray pull-out operation can be realized with a simple configuration in which the first link member 71 is formed to have a triangular shape.

The abutment member 73 includes the recess 73*a* that is recessed toward the upstream side from the downstream end of the abutment member 73 in the tray pull-out direction J1. The third corner portion 71*b*3 of the first link member 71 enters the recess 73*a* in a state in which the paper feed tray 2 is accommodated in the accommodating part 30. With the configuration above, the following effects are achieved.

Since the third corner portion 71*b*3 of the first link member 71 enters the recess 73*a* of the abutment member 73 in the tray accommodated state, the size of the paper feeding device 1 can be reduced in the tray pull-out direction J1.

A plurality of rectifying members 6 are provided. The plurality of rectifying members 6 include the first rectifying member 6A and the second rectifying member 6B disposed downstream of the first rectifying member 6A in the tray pull-out direction J1. The retreat mechanism 7 further includes the third support part 74 fixed to the device body 3 and configured to support the upstream end portion in the tray pull-out direction J1 of the second rectifying member 6B to be rotatable around the fourth axis C4, the second link member 75 having the second elongated hole 75*a* which supports the downstream end portion in the tray pull-out direction J1 of the second rectifying member 6B and the fifth axis C5 to be displaceable, and the fourth support part 76 fixed to the device body 3 and configured to support the downstream end portion in the tray pull-out direction J1 of the second link member 75 to be rotatable around the sixth axis C6. The abutment member 73 comes into contact with the second rectifying member 6B and rotates the second rectifying member 6B around the fourth axis C4 to displace the fifth axis C5 upward so that the second link member 75 is rotated around the sixth axis C6 at the time of the pull-out operation of the paper feed tray 2. With the configuration above, the following effects are achieved.

With a simple structure in which the third support part 74, the second link member 75, and the fourth support part 76 are provided on the device body 3 side while the abutment member 73 is provided on the paper feed tray 2 side, an interlocking operation of the second rectifying member 6B at the time of the tray pull-out operation can be realized. In addition, the uppermost sheet of paper 11 can be easily caused to rise up in a wide range as compared with a case in which only one rectifying member 6 is disposed.

A plurality of rectifying members 6 are provided. The plurality of rectifying members 6 include the first rectifying member 6A and the second rectifying member 6B disposed upstream of the first rectifying member 6A in the tray push-in direction J2. The retreat mechanism 7 further includes the third support part 74 fixed to the device body 3 and configured to support the downstream end portion in the tray push-in direction J2 of the second rectifying member 6B to be rotatable around the fourth axis C4, the second link member 75 having the second elongated hole 75*a* which supports the upstream end portion in the tray push-in direction J2 of the second rectifying member 6B and the fifth axis C5 to be displaceable, and the fourth support part 76 fixed to the device body 3 and configured to support the upstream end portion in the tray push-in direction J2 of the second link member 75 to be rotatable around the sixth axis C6. The abutment member 73 comes into contact with the second link member 75 and rotates the second link member around the sixth axis C6 to displace the fifth axis C5 upward so that the second rectifying member 6B is rotated around the fourth axis C4 to cause the second rectifying member 6B to retreat from the paper feed tray 2 at the time of the push-in operation of the paper feed tray 2. With the configuration above, the following effects are achieved.

With a simple structure in which the third support part 74, the second link member 75, and the fourth support part 76 are provided on the device body 3 side while the abutment member 73 is provided on the paper feed tray 2 side, an interlocking operation of the second rectifying member 6B at the time of the tray push-in operation can be realized. In addition, the uppermost sheet of paper 11 can be easily caused to rise up in a wide range as compared with a case in which only one rectifying member 6 is disposed.

The second link member 75 has a V shape. The second link member 75 includes the first extending portion 75*b*1 having the second elongated hole 75*a*, and the second extending portion 75*b*2 connected to the first extending portion 75*b*1 and directed downward. The abutment member 73 comes into contact with the second extending portion 75*b*2 of the second link member 75 at the time of the push-in operation of the paper feed tray 2. With the configuration above, the following effects are achieved.

The interlocking operation of the second rectifying member 6B at the time of the tray push-in operation can be realized with a simple configuration in which the second link member 75 is formed to have a V shape.

The paper feed tray 2 includes the tray side plates 27 and 28 disposed at both the upstream end portion and the downstream end portion of the paper feed tray 2 in the tray pull-out direction J1. The tray side plates 27 and 28 respectively include the blowing port 27*a* and 28*a* that open such that the airflow from the fan 4 flows between an upper surface of the uppermost sheet of paper 11 and a lower surface of the rectifying member 6. With the configuration above, the following effects are achieved.

A negative pressure is easily generated between the upper surface 11*a* of the uppermost sheet of paper 11 and the lower surface 6*f*2 of the rectifying member 6 compared to a case in which a blowing port opens toward a side surface of the paper bundle 10. Therefore, the uppermost sheet of paper 11 is easily separated from the paper bundle 10 placed on the paper feed tray 2. In addition, a gap between the tray side plates 27 and 28 and the paper bundle 10 is made as small as possible by positioning the paper bundle 10 in the tray pull-out direction J1 using the tray side plates 27 and 28 (by partitioning the paper bundle 10). Therefore, airflow cannot easily flow between the tray side plates 27 and 28 and the paper bundle 10. Therefore, the airflow can be caused to efficiently flow between the upper surface 11*a* of the uppermost sheet of paper 11 and the lower surface 6*f*2 of the rectifying member 6.

The paper feed tray 2 includes the paper loading part 26 on which the paper bundle 10 can be placed. The fan 4 is fixed to a side portion of the paper feed tray 2 on a side opposite to the paper loading part 26. The fan 4 includes the blow-off outlet 4Ah that opens toward the blowing port 27*a*. With the configuration above, the following effects are achieved.

An airflow guide path of the airflow from the fan 4 can be shortened compared to a case in which the blow-off outlet 4Ah of the fan 4 opens in a direction different from the blowing port 27*a*. Specifically, due to the blow-off outlet 4Ah of the fan 4 opening upward (toward a portion at which the blowing port 27*a* is positioned), the airflow guide path of the airflow from the fan 4 can be shortened compared to a case in which the blow-off outlet 4Ah of the fan 4 opens downward.

The tray side plates 27 and 28 extend in the vertical direction. The blowing ports 27*a* and 28*a* are respectively positioned at upper end portions of the tray side plates 27 and 28. The paper feeding device 1 further includes the duct 5 connecting each of the upper end portions of the tray side plates 27 and 28 to the fan 4 so that the airflow from the blow-off outlets 4Ah and 4Bh of the fan 4 flows toward the blowing ports 27*a* and 28*a* of the tray side plates 27 and 28. With the configuration above, the following effects are achieved.

The airflow from the blow-off outlets 4Ah and 4Bh of the fan 4 can be caused to flow toward the blowing ports 27*a* and 28*a* of the tray side plates 27 and 28 through the duct 5.

The retreat mechanism 7 achieves the following effects by being disposed at a position other than the blowing ports 27*a* and 28*a*.

When the airflow flows out from the blowing ports 27*a* and 28*a*, the retreat mechanism 7 can be inhibited from becoming obstacle.

Since the rectifying member 6 has an airfoil shape, the following effects are achieved.

It is easier to generate a high negative pressure (that is, a low pressure) between the rectifying member 6 and the uppermost sheet of paper 11 as compared with a case in which the rectifying member 6 has a flat plate shape. Therefore, the uppermost sheet of paper 11 can be easily separated from the paper bundle 10 placed on the paper feed tray 2.

The blowing ports 27*a* and 28*a* are each positioned at the central portion of the uppermost sheet of paper 11 in the device width direction W1. The lowermost surfaces of the rectifying members 6A and 6B are positioned below the upper ends of the blowing ports 27*a* and 28*a*. With the configuration above, the following effects are achieved.

The uppermost sheet of paper 11 can be caused to efficiently rise up compared to a case in which the blowing ports 27*a* and 28*a* are positioned at end portions in the device width direction W1 of the uppermost sheet of paper 11.

The rectifying members 6A and 6B are positioned above the uppermost sheet of paper 11 in the tray accommodated state. The lowermost surfaces of the rectifying members 6A and 6B are positioned below the upper ends of the tray side plates 27 and 28. With the configuration above, the following effects are achieved.

Excessive rising-up of the uppermost sheet of paper 11 can be inhibited. In addition, since the uppermost sheet of paper 11 is positioned by the tray side plates 27 and 28, the uppermost sheet of paper 11 that has been caused to rise up can be fed without changing its orientation. As described above, in the tray accommodated state, the lowermost surfaces of the rectifying members 6A and 6B need to be positioned below the upper ends of the tray side plates 27 and 28. Therefore, the retreat mechanism 7 for retreating the rectifying member 6 from the paper feed tray 2 is required in both the pull-out operation and the push-in operation of the paper feed tray 2.

Hereinafter, a second embodiment will be described.

In the first embodiment, a case in which the retreat mechanism 7 includes the first support part 70, the first link member 71, the second support part 72, and the abutment member 73 has been described, but the present invention is not limited thereto. The second embodiment differs from the first embodiment in a configuration of the retreat mechanism. In the second embodiment, configurations the same as those in the above-described first embodiment will be denoted by the same references, and a detailed description thereof will be omitted here.

Figure 25:
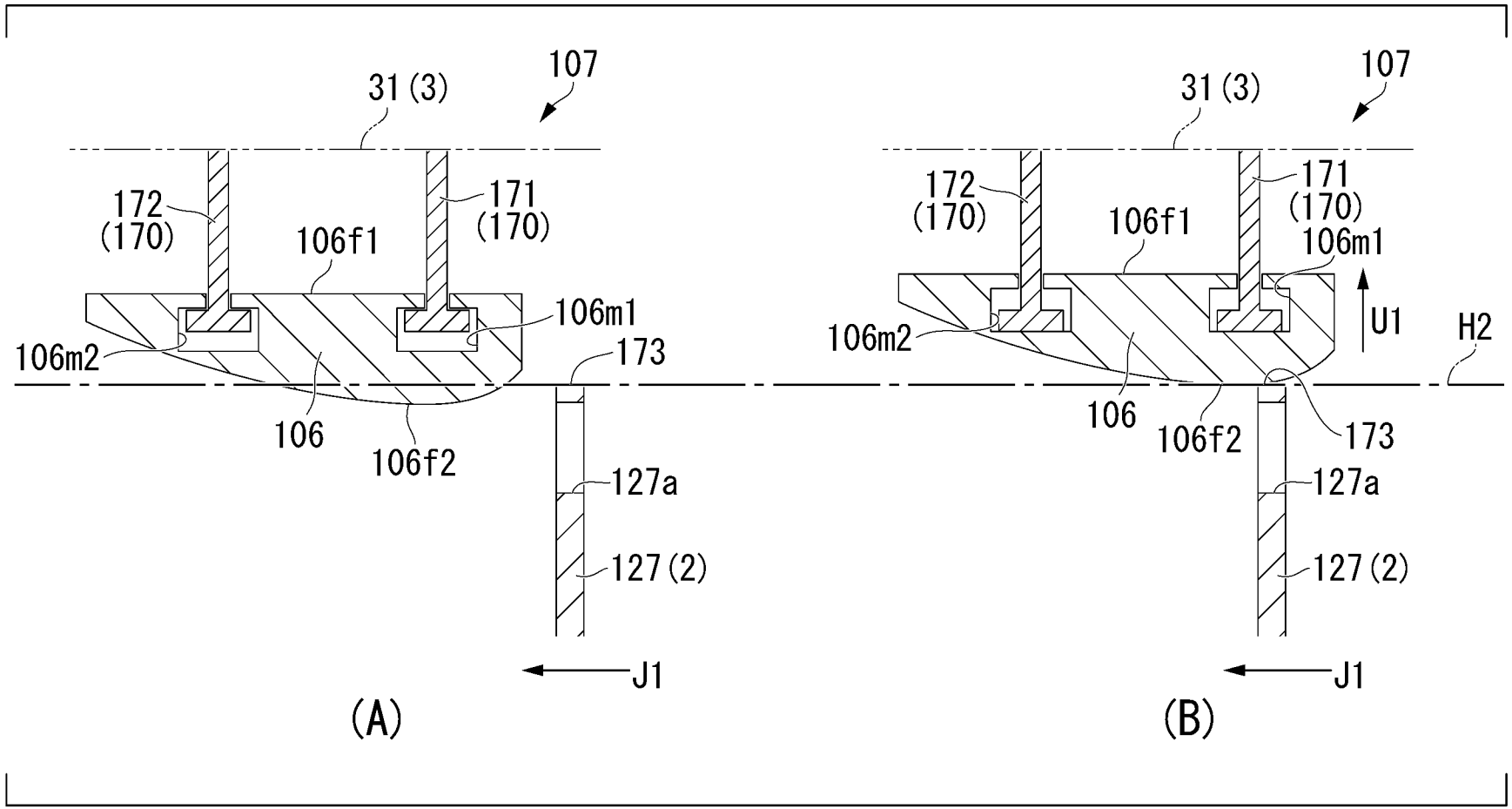
FIG. 25 is an operation explanatory view of a retreat mechanism of a second embodiment.

FIG. 25 is an operation explanatory view of a retreat mechanism 107 of the second embodiment. FIG. 25(A) is a side view showing an initial position of a paper feed tray 2. FIG. 25(B) is a side view showing a state in which the paper feed tray 2 is moved to a position downstream of the initial position in a tray pull-out direction J1.

As shown in FIG. 25, the retreat mechanism 107 may include a pin member 170 and an abutment part 173.

The pin member 170 is fixed to a top wall 31 of a device body 3. The pin member 170 supports a rectifying member 106 to be displaceable in a vertical direction. A plurality of (for example, two) pin members 170 are provided. Hereinafter, the pin member 170 supporting an upstream portion in the tray pull-out direction J1 of the rectifying member 106 is also referred to as "first pin member 171," and the pin member 170 supporting a downstream portion in the tray pull-out direction J1 of the rectifying member 106 is also referred to as "second pin member 172."

The first pin member 171 supports the upstream portion in the tray pull-out direction J1 of the rectifying member 106 to be displaceable in the vertical direction. The first pin member 171 has an inverted T shape.

The second pin member 172 supports the downstream portion in the tray pull-out direction J1 of the rectifying member 106 to be displaceable in the vertical direction. The second pin member 172 has an inverted T shape whose axis portion is substantially parallel to that of the first pin member 171.

In the drawing, reference 106*m*1 denotes a first guide groove formed at the upstream portion in the tray pull-out direction J1 of the rectifying member 106, and reference 106*m*2 denotes a second guide groove formed at the downstream portion in the tray pull-out direction J1 of the rectifying member 106. A lower end portion of the first pin member 171 is vertically displaceable along the first guide groove 106*m*1. A lower end portion of the second pin member 172 is vertically displaceable along the second guide groove 106*m*2.

The abutment part 173 is provided at an upper end portion of a first tray side plate 127 of the paper feed tray 2. That is, the abutment part 173 is the upper end portion of the first tray side plate 127 of the paper feed tray 2. In both a pull-out operation and a push-in operation of the paper feed tray 2, the abutment part 173 comes into contact with a curved lower surface 106*f*2 of the rectifying member 106. Thereby, the abutment part 173 displaces the rectifying member 106 upward in conjunction with movement of the paper feed tray 2 so that the rectifying member 106 retreats from the paper feed tray 2.

An example of an operation of a retreat mechanism of the second embodiment at the time of the pull-out operation of the paper feed tray 2 will be described with reference to FIG. 25. In FIG. 25, the pull-out operation of the paper feed tray 2 is described, and description of the push-in operation of the paper feed tray 2 is omitted. Reference H2 in the drawing indicates a virtual horizontal line passing through an upper end of the abutment part 173.

As shown in FIG. 25(A), the abutment part 173 is separated from the rectifying member 106 when the paper feed tray 2 is at the initial position. When the paper feed tray 2 is at the initial position, the curved lower surface 106*f*2 of the rectifying member 106 is positioned below the virtual horizontal line H2. In the state of FIG. 25(A), the rectifying member 106 is positioned at a regular position by a weight thereof.

As shown in FIG. 25(B), when the paper feed tray 2 is moved in the arrow J1 direction from the initial position of the paper feed tray 2, the abutment part 173 comes into contact with the curved lower surface 106/2 of the rectifying member 106. Then, the rectifying member 106 is displaced in an arrow U1 direction (upward) to retreat from the paper feed tray 2. In the present embodiment, the rectifying member 106 is displaced upward along both the first pin member 171 and the second pin member 172. At this time, the curved lower surface 106/2 of the rectifying member 106 overlaps the virtual horizontal line H2.

Also, when the paper feed tray 2 is moved in the arrow J1 direction from the position thereof in FIG. 25(B), the abutment part 173 moves while avoiding the rectifying member 106 while touching the curved lower surface 106/2 of the rectifying member 106.

According to the second embodiment, the retreat mechanism 107 includes the pin member 170 fixed to the device body 3 and configured to support the rectifying member 106 to be displaceable in the vertical direction, and the abutment part 173 provided at the paper feed tray 2 and configured to come into contact with the rectifying member 106 and displace the rectifying member 106 upward in conjunction with movement of the paper feed tray 2 so that the rectifying member 106 retreats from the paper feed tray 2 in both the pull-out operation and the push-in operation of the paper feed tray 2. With the configuration above, the following effects are achieved.

An interlocking operation during the tray pull-out operation and the tray push-in operation can be realized with a simpler configuration than when the retreat mechanism includes the first support part 70, the first link member 71, the second support part 72, and the abutment member 73.

A plurality of pin members 170 are provided. The plurality of pin members 170 include the first pin member 171 which supports the upstream portion in the tray pull-out direction J1 of the rectifying member 106 to be displaceable in the vertical direction, and the second pin member 172 which supports the downstream portion in the tray pull-out direction J1 of the rectifying member 106 to be displaceable in the vertical direction. With the configuration above, the following effects are achieved.

Compared to a case in which only one pin member 170 is provided, the rectifying member 106 can be supported more stably.

The rectifying member 106 includes the curved lower surface 106/2 that is curved to be convex downward. The paper feed tray 2 includes the tray side plate 127 disposed at an upstream end portion in the tray pull-out direction J1 of the paper feed tray 2. The abutment part 173 is provided at the upper end portion of the tray side plate 127. The abutment part 173 comes into contact with the curved lower surface 106/2 of the rectifying member 106 in both the pull-out operation and the push-in operation of the paper feed tray 2. With the configuration above, the following effects are achieved.

The rectifying member 106 can be smoothly displaced upward in conjunction with the movement of the abutment part 173 at the time of the tray pull-out operation and the tray push-in operation.

A modified example of the second embodiment will be described.

In the second embodiment, a case in which the abutment part 173 is the upper end portion of the tray side plate extending in the vertical direction has been described, but the present invention is not limited thereto. The modified example of the second embodiment differs from the second embodiment in a shape of the abutment part. In the present modified example, configurations the same as those in the above-described second embodiment will be denoted by the same references, and a detailed description thereof will be omitted here.

Figure 26:
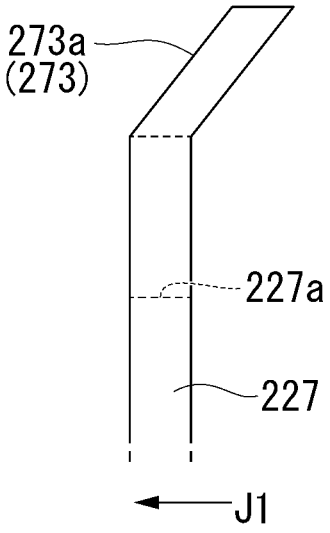
FIG. 26 is a side view of a tray side plate of a modified example of the second embodiment.

FIG. 26 is a side view of a tray side plate 227 according to the modified example of the second embodiment.

As shown in FIG. 26, an abutment part 273 may have a tapered shape that is inclined with respect to a vertical line. The abutment part 273 has an inclined surface 273*a* which is inclined such that an upper end thereof is positioned on a most upstream side and a lower end thereof is positioned on a most downstream side in the tray pull-out direction J1. In the present modified example, a blowing port 227*a* is positioned below a position of the blowing port in FIG. 25 (A).

According to the present modified example, since the abutment part 273 has a tapered shape that is inclined with respect to a vertical line, the following effects can be achieved.

As compared with a case in which the abutment part 273 is the upper end portion of the tray side plate 127 extending in the vertical direction, the rectifying member 106 can be more smoothly displaced upward in conjunction with the movement of the abutment part 273 at the time of the tray pull-out operation. In addition, even when the abutment part 273 is in contact with a side surface (a surface other than the curved lower surface 106/2) of the rectifying member 106, the rectifying member 106 can be displaced upward.

A third embodiment will be described.

In the second embodiment, a case in which the retreat mechanism 107 includes the pin member 170 and the abutment part 173 has been described, but the present invention is not limited thereto. The third embodiment differs from the second embodiment in a configuration of the retreat mechanism. In the present third embodiment, configurations the same as those in the above-described second embodiment will be denoted by the same references, and a detailed description thereof will be omitted here.

Figure 27:
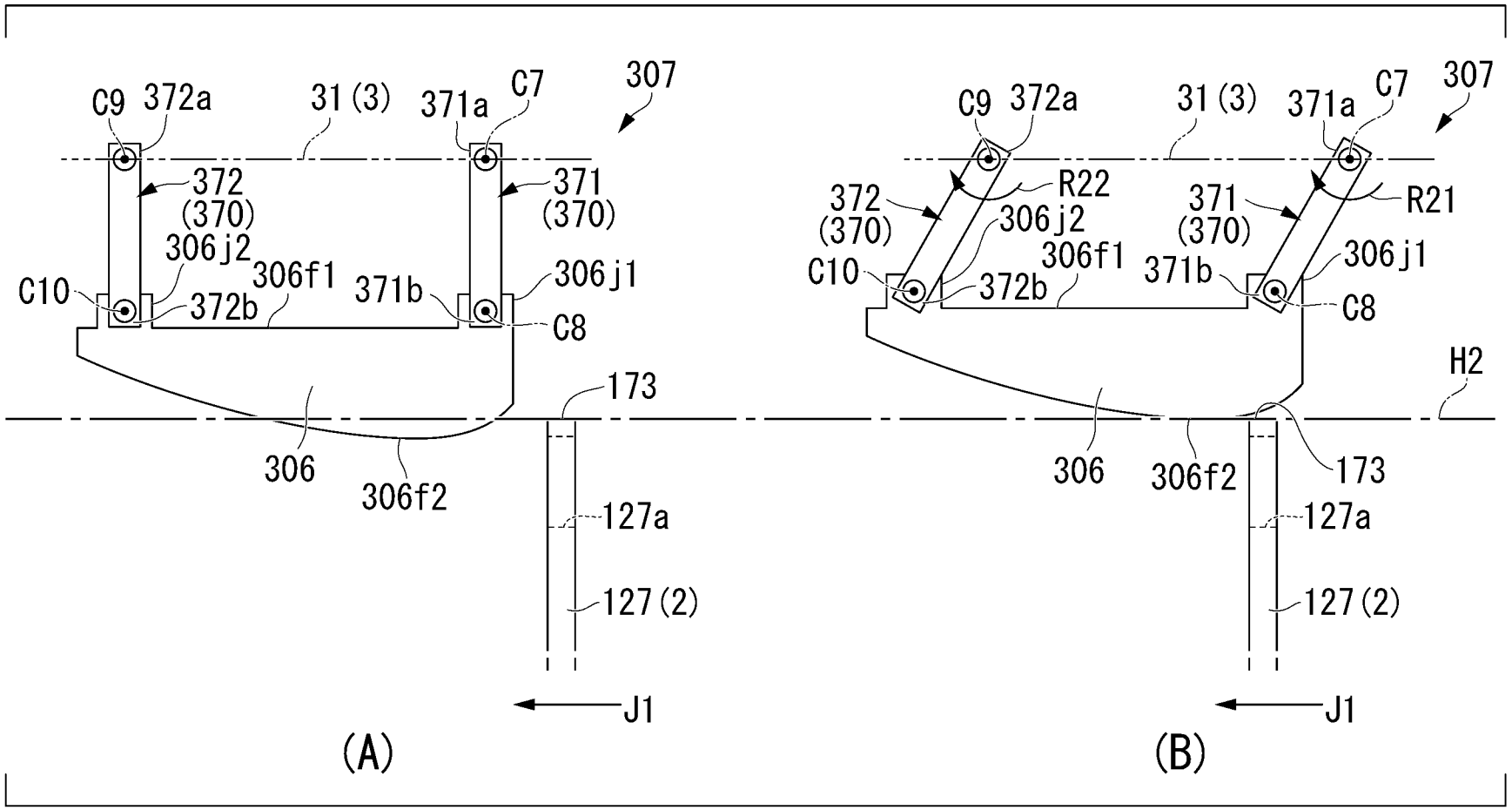
FIG. 27 is an operation explanatory view of a retreat mechanism of a third embodiment.

FIG. 27 is an operation explanatory view of a retreat mechanism 307 of the third embodiment. FIG. 27(A) is a side view showing an initial position of a paper feed tray 2. FIG. 27(B) is a side view showing a state in which the paper feed tray 2 is moved to a position downstream of the initial position in the tray pull-out direction J1.

As shown in FIG. 27, the retreat mechanism 307 may include a connecting member 370 and an abutment part 173.

The connecting member 370 rotatably supports a rectifying member 306. The connecting member 370 is rotatably connected to a top wall 31 of a device body 3. A plurality of (for example, two) connecting members 370 are provided. Hereinafter, the connecting member 370 supporting an upstream portion in the tray pull-out direction J1 of the rectifying member 306 is also referred to as "first connecting member 371," and the connecting member 370 supporting a downstream portion in the tray pull-out direction J1 of the rectifying member 306 is also referred to as "second connecting member 372."

The first connecting member 371 has a rod shape. The first connecting member 371 includes a first upper rotating portion 371*a* and a first lower rotating portion 371*b*. The first upper rotating portion 371*a* is connected to the top wall 31 of the device body 3 to be rotatable around a seventh axis C7 (an axis substantially parallel to a device width direction W1). The first lower rotating portion 371*b* supports the upstream portion in the tray pull-out direction J1 of the rectifying member 306 to be rotatable around an eighth axis C8 (an axis substantially parallel to the seventh axis C7).

The second connecting member 372 has a rod shape substantially parallel to the first connecting member 371. The second connecting member 372 includes a second upper rotating portion 372*a* and a second lower rotating portion 372*b*. The second upper rotating portion 372*a* is connected to the top wall 31 of the device body 3 to be rotatable around a ninth axis C9 (an axis substantially parallel to the seventh axis C7). The second lower rotating portion 372*b* supports the downstream portion in the tray pull-out direction J1 of the rectifying member 306 to be rotatable around a tenth axis C10 (an axis substantially parallel to the seventh axis C7).

In the drawing, reference 306*j*1 denotes a first protrusion provided at the upstream portion in the tray pull-out direction J1 of the rectifying member 306, and reference 306*j*2 denotes a second protrusion provided at the downstream portion in the tray pull-out direction J1 of the rectifying member 306. A lower end portion of the first connecting member 371 (first lower rotating portion 371*b*) supports the first protrusion 306*j*1 to be rotatable around the eighth axis C8. A lower end portion of the second connecting member 372 (second lower rotating portion 372*b*) supports the second protrusion 306*j*2 to be rotatable around the tenth axis C10.

An example of an operation of the retreat mechanism of the third embodiment at the time of the pull-out operation of the paper feed tray 2 will be described with reference to FIG. 27. In FIG. 27, the pull-out operation of the paper feed tray 2 is described, and description of a push-in operation of the paper feed tray 2 is omitted. Reference H2 in the drawing indicates a virtual horizontal line passing through an upper end of the abutment part 173.

As shown in FIG. 27(A), the abutment part 173 is separated from the rectifying member 306 when the paper feed tray 2 is at the initial position. When the paper feed tray 2 is at the initial position, a curved lower surface 306*f*2 of the rectifying member 306 is positioned below the virtual horizontal line H1. In the state shown in FIG. 27(A), the rectifying member 306 is positioned at a regular position by a weight thereof.

As shown in FIG. 27(B), when the paper feed tray 2 is moved in the arrow J1 direction from the initial position of the paper feed tray 2, the abutment part 173 comes into contact with the curved lower surface 306*f*2 of the rectifying member 306. Then, the rectifying member 306 is displaced upward to retreat from the paper feed tray 2. In the present embodiment, the first connecting member 371 rotates around the seventh axis C7 in an arrow R21 direction (clockwise in the drawing), the second connecting member 372 rotates around the ninth axis C9 in an arrow R22 (clockwise in the drawing), so that the rectifying member 306 is displaced obliquely upward. At this time, the curved lower surface 306*f*2 of the rectifying member 306 overlaps the virtual horizontal line H2.

When the paper feed tray 2 is moved in the arrow J1 direction from the position thereof in FIG. 27(B), the abutment part 173 moves while avoiding the rectifying member 306 while touching the curved lower surface 306*f*2 of the rectifying member 306.

Figure 28:
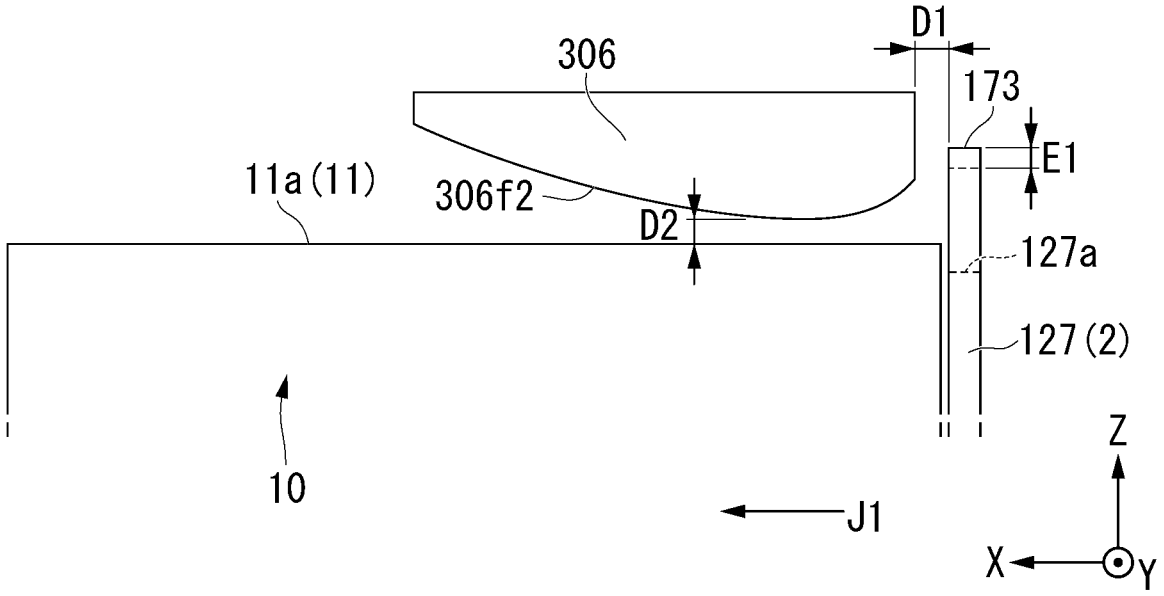
FIG. 28 is a disposition explanatory view of a tray side plate and a rectifying member of the third embodiment.

A disposition of the tray side plate and the rectifying member 306 according to the third embodiment will be described with reference to FIG. 28. In the drawing, reference E1 indicates a length of an upper surface of a blowing port 127*a* of a tray side plate 127 (hereinafter also referred to as "blowing port upper length"), reference D1 indicates a distance between the tray side plate 127 and the rectifying member 306 (hereinafter also referred to as "first distance"), reference D2 indicates a distance between an uppermost sheet of paper 11 and the rectifying member 306 (hereinafter also referred to as "second distance"). The blowing port upper length E1 means the shortest distance between an upper end of the tray side plate 127 and an upper end of the blowing port 127*a*. The first distance D1 means a shortest distance between the tray side plate 127 and the rectifying member 306 in the tray pull-out direction J1. The second distance D2 means a shortest distance between an upper surface 11*a* of the uppermost sheet of paper 11 and the curved lower surface 306*f*2 of the rectifying member 306.

In the third embodiment, in order to cause the uppermost sheet of paper 11 to efficiently rise up at a low flow rate, settings are made as follows.

The blowing port upper length E1 is set as long as possible so that airflow flowing out from the blowing port 127*a* flows between the upper surface of the uppermost sheet of paper 11 and the curved lower surface 306*f*2 of the rectifying member 306 without leakage.

The first distance D1 is set as small as possible so that the airflow flowing out from the blowing port 127*a* flows between the upper surface of the uppermost sheet of paper 11 and the curved lower surface 306*f*2 of the rectifying member 306 without leakage.

The second distance D2 is set as small as possible so that a negative pressure is easily generated between the upper surface of the uppermost sheet of paper 11 and the curved lower surface 306*f*2 of the rectifying member 306 using the airflow flowing out from the blowing port 127*a*.

According to the third embodiment, the retreat mechanism 307 includes the connecting member 370 supporting the rectifying member 306 and rotatably connected to the device body 3, and the abutment part 173 provided at the paper feed tray 2 and configured to come into contact with the rectifying member 306 and displace the rectifying member 306 upward in conjunction with the movement of paper feed tray 2 so that the rectifying member 306 retreats from the paper feed tray 2 in both the pull-out operation and the push-in operation of the paper feed tray 2. With the configuration above, the following effects are achieved.

An interlocking operation during the tray pull-out operation and the tray push-in operation can be realized with a simpler configuration than when the retreat mechanism 7 includes the first support part 70, the first link member 71, the second support part 72, and the abutment member 73.

A plurality of connecting members 370 are provided. The plurality of connecting members 370 include the first connecting member 371 supporting the upstream portion in the tray pull-out direction J1 of the rectifying member 306 and rotatably connected to the device body 3, and the second connecting member 372 supporting the downstream portion in the tray pull-out direction J1 of the rectifying member 306 and rotatably connected to the device body 3. With the configuration above, the following effects are achieved.

Compared to a case in which only one connecting member 370 is provided, the rectifying member 306 can be supported more stably.

Since the connecting member 370 includes the lower rotating portions 371*b* and 372*b* which rotatably support the rectifying member 306, the following effects are achieved.

As compared with a case in which connecting member 370 fixedly supports the rectifying member 306, the rectifying member 306 can be more smoothly displaced upward in conjunction with the movement of the abutment part 173 at the time of the tray pull-out operation and the tray push-in operation.

In the embodiment described above, a case in which the paper feeding device 1 is disposed adjacent to a side portion of the paper accommodating unit 94 of the image forming device 90 (a case of functioning as a large-capacity expansion unit for expanding a paper accommodating capacity of the paper accommodating unit 94) has been described, but the present invention is not limited thereto. For example, the paper feeding device may be disposed at a lowermost level of the paper accommodating unit 94. In other words, the paper feed tray of the paper feeding device may function as a cassette of at least a part of the paper accommodating unit 94. That is, the image forming device may include the paper feeding device.

In the embodiment described above, a case in which the paper feeding device 1 is applied to the image forming device 90 such as a printer has been described, but the present invention is not limited thereto. For example, the paper feeding device may be applied to financial instruments, postal sorting machines, printing machines, copying machines, facsimile machines, multi-function printers, and the like. Further, the multi-function printers may be for business use or office use and may be those including paper of various types. In addition, the paper feeding device may be applied to a sheet separating device. Also, the paper feeding device may be applied to a device for not only taking out paper but also taking out those in a form of stacked sheets.

In the embodiment described above, the paper feeding device 1 for feeding paper has been described, but the present invention is not limited thereto. For example, the present invention may be applied to thin film electrodes of a secondary battery instead of paper. That is, the present invention may be applied to an electrode feeding device for feeding thin film electrodes instead of the paper feeding device. An electrode feeding device includes an electrode feed tray (not shown, corresponding to the paper feed tray 2), a device body 3, a fan 4, a rectifying member 6, and a retreat mechanism 7. An electrode bundle in which a plurality of thin film electrodes are stacked can be placed on the electrode feed tray. The device body 3 includes an accommodating part 30 capable of accommodating the electrode feed tray. The fan 4 can generate airflow. The rectifying member 6 is positioned above the electrode bundle placed on the electrode feed tray in a state in which the electrode feed tray is accommodated in the accommodating part 30. The rectifying member 6 generates a negative pressure between the rectifying member 6 and an uppermost electrode of the electrode bundle using the airflow from the first fan 4 in a state in which the electrode feed tray is accommodated in the accommodating part 30. The retreat mechanism 7 displaces the rectifying member 6 in conjunction with movement of the electrode feed tray so that the rectifying member 6 retreats from the electrode feed tray in both a pull-out operation and a push-in operation of the electrode feed tray.

In the above-described embodiment, a case in which the retreat mechanism displaces the rectifying member 6 in conjunction with the movement of the paper feed tray 2 so that the rectifying member retreats from the paper feed tray 2 in both the pull-out operation and the push-in operation of the paper feed tray 2 has been described, but the present invention is not limited thereto. For example, the retreat mechanism may displace the rectifying member in conjunction with the movement of the paper feed tray 2 so that the rectifying member retreats from the paper feed tray 2 only at the time of the pull-out operation of the paper feed tray 2. For example, the retreat mechanism may displace the rectifying member in conjunction with the movement of the paper feed tray 2 so that the rectifying member retreats from the paper feed tray 2 only at the time of the push-in operation of the paper feed tray 2. That is, the retreat mechanism may displace the rectifying member in conjunction with the movement of the paper feed tray 2 so that the rectifying member retreats from the paper feed tray 2 in at least one of the pull-out operation and the push-in operation of the paper feed tray 2.

In the embodiment described above, a case in which the tray side plates are disposed at both the upstream end portion and the downstream end portion of the paper feed tray 2 in the tray pull-out direction J1 has been described, but the present invention is not limited thereto. For example, the tray side plate may be disposed only at the upstream end portion in the tray pull-out direction J1 of the paper feed tray 2. For example, the tray side plate may be disposed only at the downstream end portion in the tray pull-out direction J1 of the paper feed tray 2. That is, the tray side plate is disposed at at least one of the upstream end portion and the downstream end portion of the paper feed tray 2 in the tray pull-out direction J1.

In the above-described embodiment, a case in which the rectifying member is disposed above the paper bundle 10 and the plurality of rectifying members are disposed one at each of the upstream portion and the downstream portion of the top wall 31 in the tray pull-out direction J1 has been described, but the present invention is not limited thereto. For example, a plurality of rectifying members may be disposed at each of the upstream portion and the downstream portion in the tray pull-out direction J1 of the top wall 31. According to this configuration, airflow can be sent to respective spaces between the plurality of rectifying members and the uppermost sheet of paper 11. For example, even when a paper size is larger (for example, A3 size or more) than a preset threshold value (hereinafter referred to as "size threshold value"), the uppermost sheet of paper 11 can be stably separated.

In the above-described embodiment, a case in which a plurality of rectifying members are disposed above the paper bundle 10 has been described, but the present invention is not limited thereto. For example, only one rectifying member may be disposed above the paper bundle 10. For example, one rectifying member may be disposed at any one of the upstream portion and the downstream portion 31 in the tray pull-out direction J1 of the top wall.

In the above-described embodiment, a case in which a vertical position of the paper loading part 26 is kept constant has been described, but the present invention is not limited thereto. For example, the paper loading part 26 may rise so that a vertical position of the uppermost sheet of paper 11 does not substantially change at the time of paper feeding. Thereby, the uppermost sheet of paper 11 can be stably separated. That is, an air-assistance effect can be maintained constant.

According to at least one of the embodiments described above, the paper feeding device 1 in which the rectifying member 6 can be inhibited from becoming obstacle when the paper feed tray 2 moves can be provided by including the paper feed tray 2 on which the paper bundle 10 in which a plurality of sheets of paper are stacked can be placed, a device body 3 having the accommodating part 30 capable of accommodating the paper feed tray 2, the fan 4 which can generate airflow, the rectifying member 6 positioned above the paper bundle 10 placed on the paper feed tray 2 and configured to generate a negative pressure between the rectifying member 6 and the uppermost sheet of paper 11 of the paper bundle 10 using the airflow from the fan 4 in a state in which the paper feed tray 2 is accommodated in the accommodating part 30, and the retreat mechanism 7 which displaces the rectifying member 6 in conjunction with movement of the paper feed tray 2 so that the rectifying member 6 retreats from the paper feed tray 2 in at least one of the pull-out operation and the push-in operation of the paper feed tray 2.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A paper feeding device comprising:

a paper feed tray on which a paper bundle in which a plurality of sheets of paper are stacked is able to be placed;

a device body including an accommodating part which is able to accommodate the paper feed tray;

a fan which is able to generate airflow;

a rectifying member positioned above the paper bundle placed on the paper feed tray and generates a negative pressure between the rectifying member and an uppermost sheet of paper of the paper bundle using the airflow from the fan in a state in which the paper feed tray is accommodated in the accommodating part; and a retreat mechanism which displaces the rectifying member in conjunction with the paper feed tray so that the rectifying member retreats from the paper feed tray in at least one of a pull-out operation and a push-in operation of the paper feed tray, wherein the retreat mechanism includes:

a first support part which supports a downstream end portion in a tray pull-out direction of the rectifying member to be rotatable around a first axis;

a link member having an elongated hole which supports an upstream end portion in the tray pull-out direction of the rectifying member and a second axis to be displaceable;

a second support part which supports an upstream end portion in the tray pull-out direction of the link member to be rotatable around a third axis; and an abutment member fixed to the paper feed tray and configured to come into contact with the link member and rotate the link member around the third axis to displace the second axis upward so that the rectifying member is rotated around the first axis to cause the rectifying member to retreat from the paper feed tray at the time of the pull-out operation of the paper feed tray.

2. The paper feeding device according to claim 1, wherein the retreat mechanism displaces the rectifying member to an internal space of the paper feed tray in a state in which the paper feed tray is accommodated in the accommodating part, and displaces the rectifying member to an external space of the paper feed tray in a state in which the paper feed tray is taken out of the accommodating part.

3. The paper feeding device according to claim 2, wherein the retreat mechanism includes:

the first support part which supports the upstream end portion in a tray push-in direction of the rectifying member to be rotatable around the first axis;

the link member having the elongated hole which supports the downstream end portion in the tray push-in direction of the rectifying member and the second axis to be displaceable;

the second support part which supports a downstream end portion in the tray push-in direction of the link member to be rotatable around the third axis; and the abutment member fixed to the paper feed tray and comes into contact with the rectifying member and rotate the rectifying member around the first axis to displace the second axis upward so that the link member is rotated around the third axis at the time of the push-in operation of the paper feed tray.

4. The paper feeding device according to claim 1, wherein the link member has a triangular shape which is convex downward, the link member includes:

a first corner portion having the elongated hole;

a second corner portion supported to be rotatable around the third axis; and a third corner portion which is convex downward, and the abutment member comes into contact with the third corner portion of the link member at the time of the pull-out operation of the paper feed tray.

5. The paper feeding device according to claim 4, wherein the abutment member includes a recess that is recessed toward an upstream side from a downstream end of the abutment member in the tray pull-out direction so that the third corner portion of the link member is entered therein in a state in which the paper feed tray is accommodated in the accommodating part.

6. The paper feeding device according to claim 1, wherein the plurality of rectifying members are provided, the plurality of rectifying members include;

a first rectifying member; and a second rectifying member disposed on a downstream side in the tray pull-out direction of the first rectifying member, the retreat mechanism further includes:

a third support part which supports an upstream end portion in the tray pull-out direction of the second rectifying member to be rotatable around a fourth axis;

a second link member having a second elongated hole which supports the downstream end portion in the tray pull-out direction of the rectifying member and a fifth axis to be displaceable; and a fourth support part which supports a downstream end portion in the tray pull-out direction of the second link member to be rotatable around a sixth axis, and the abutment member comes into contact with the second rectifying member and rotates the second rectifying member around the fourth axis to displace the fifth axis upward so that the second link member is rotated around the sixth axis at the time of the tray pull-out operation of the paper feed tray.

7. The paper feeding device according to claim 1, wherein the plurality of rectifying members are provided, the plurality of rectifying members include:

the first rectifying member; and the second rectifying member disposed on an upstream side in the tray push-in direction of the first rectifying member, the retreat mechanism further includes:

the third support part which supports a downstream end portion in the tray push-in direction of the second rectifying member to be rotatable around the fourth axis;

the second link member having the second elongated hole which supports the upstream end portion in the tray push-in direction of the rectifying member and the fifth axis to be displaceable; and the fourth support part which supports an upstream end portion in the tray push-in direction of the second link member to be rotatable around the sixth axis, and the abutment member comes into contact with the second link member and rotates the second link member around the sixth axis to displace the fifth axis upward so that the second rectifying member is rotated around the fourth axis to cause the second rectifying member to retreat from the paper feed tray at the time of the tray push-in operation of the paper feed tray.

8. The paper feeding device according to claim 6, wherein the second link member has a V shape, the second link member includes;

a first extending portion having the second elongated hole; and a second extending portion connected to the first extending portion and directed downward, and the abutment member comes into contact with the second extending portion of the second link member at the time of the tray push-in operation of the paper feed tray.

9. The paper feeding device according to claim 2, wherein the retreat mechanism includes:

a pin member which supports the rectifying member to be displaceable in a vertical direction; and an abutment part provided at the paper feed tray and comes into contact with the rectifying member and displace the rectifying member upward in conjunction with the movement of the paper feed tray so that the rectifying member retreats from the paper feed tray in at least one of the pull-out operation and the push-in operation of the paper feed tray.

10. The paper feeding device according to claim 9, wherein a plurality of pin members are provided, and the plurality of pin members include:

a first pin member which supports an upstream portion in the tray pull-out direction of the rectifying member to be displaceable in the vertical direction; and a second pin member which supports a downstream portion in the tray pull-out direction of the rectifying member to be displaceable in the vertical direction.

11. The paper feeding device according to claim 2, wherein the retreat mechanism includes:

a connecting member supporting the rectifying member and rotatably connected to the device body; and an abutment part provided at the paper feed tray and comes into contact with the rectifying member and displace the rectifying member upward in conjunction with the movement of the paper feed tray so that the rectifying member retreats from the paper feed tray in at least one of the pull-out operation and the push-in operation of the paper feed tray.

12. The paper feeding device according to claim 11, wherein a plurality of connecting members are provided, and the plurality of connecting members include:

a first connecting member supporting an upstream portion in the tray pull-out direction of the rectifying member and rotatably connected to the device body; and a second connecting member supporting a downstream portion in the tray pull-out direction of the rectifying member and rotatably connected to the device body.

13. The paper feeding device according to claim 11, wherein each of the connecting members includes a lower rotating portion which rotatably supports the rectifying member.

14. The paper feeding device according to claim 9, wherein the rectifying member includes a curved lower surface that is curved to be convex downward, the paper feed tray includes a tray side plate disposed at an upstream end portion in the tray pull-out direction of the paper feed tray, and the abutment part is provided at an upper end portion of the tray side plate and comes into contact with the curved lower surface of the rectifying member in at least one of the pull-out operation and the push-in operation of the paper feed tray.

15. The paper feeding device according to claim 9, wherein the abutment part has a tapered shape which is inclined with respect to a vertical line.

16. The paper feeding device according to claim 1, wherein the paper feed tray includes a tray side plate disposed at at least one of the upstream end portion and a downstream end portion of the paper feed tray in the tray pull-out direction, and the tray side plate includes a blowing port which opens so that the airflow from the fan flows between an upper surface of the uppermost sheet of paper and a lower surface of the rectifying member.

17. The paper feeding device according to claim 16, wherein the paper feed tray includes a paper loading part on which the paper bundle is able to be placed, the fan is fixed to a side portion of the paper feed tray on a side opposite to the paper loading part, and the fan includes a blow-off outlet which opens toward the blowing port.

18. The paper feeding device according to claim 17, wherein the tray side plate extends in the vertical direction, the blowing port is positioned at the upper end portion of the tray side plate, and the paper feeding device further comprises a duct connecting the upper end portion of the tray side plate to the fan so that airflow from the blow-off outlet of the fan flows toward the blowing port of the tray side plate.

19. The paper feeding device according to claim 16, wherein the retreat mechanism is disposed at a position other than the blowing port.

20. The paper feeding device according to claim 1, wherein the rectifying member has an airfoil shape.

21. An image forming device comprising the paper feeding device according to claim 1.

22. An electrode feeding device comprising:

an electrode feed tray on which an electrode bundle in which a plurality of thin film electrodes are stacked is able to be placed;

a device body including an accommodating part which is able to accommodate the electrode feed tray;

a fan which is able to generate airflow;

a rectifying member positioned above the electrode bundle placed on the electrode feed tray and generates a negative pressure between the rectifying member and an uppermost electrode of the electrode bundle using the airflow from the fan in a state in which the electrode feed tray is accommodated in the accommodating part; and a retreat mechanism which displaces the rectifying member in conjunction with movement of the electrode feed tray so that the rectifying member retreats from the electrode feed tray in at least one of a pull-out operation and a push-in operation of the electrode feed tray, wherein the retreat mechanism includes:

a first support part which supports a downstream end portion in a tray pull-out direction of the rectifying member to be rotatable around a first axis;

a link member having an elongated hole which supports an upstream end portion in the tray pull-out direction of the rectifying member and a second axis to be displaceable;

a second support part which supports an upstream end portion in the tray pull-out direction of the link member to be rotatable around a third axis; and an abutment member fixed to the paper feed tray and configured to come into contact with the link member and rotate the link member around the third axis to displace the second axis upward so that the rectifying member is rotated around the first axis to cause the rectifying member to retreat from the paper feed tray at the time of the pull-out operation of the paper feed tray.

* * * * *